US008308554B2

(12) United States Patent
Rowe et al.

(10) Patent No.: US 8,308,554 B2
(45) Date of Patent: Nov. 13, 2012

(54) PRIZE REDEMPTION KIOSK

(75) Inventors: Richard E. Rowe, Las Vegas, NV (US); Richard Pennington, Reno, NV (US); Michael M. Oberberger, Reno, NV (US)

(73) Assignee: IGT, Reno, NV (US)

( * ) Notice: Subject to any disclaimer, the term of this patent is extended or adjusted under 35 U.S.C. 154(b) by 913 days.

(21) Appl. No.: 11/821,145

(22) Filed: Jun. 22, 2007

(65) Prior Publication Data

US 2008/0318671 A1 Dec. 25, 2008

(51) Int. Cl.
*A63F 9/24* (2006.01)

(52) U.S. Cl. ..... 463/25; 463/24; 463/26; 463/40; 463/42

(58) Field of Classification Search ..... 463/25, 463/26, 42, 24, 40
See application file for complete search history.

(56) References Cited

U.S. PATENT DOCUMENTS

| | | | | |
|---|---|---|---|---|
| 6,186,893 | B1 | 2/2001 | Walker et al. | |
| 6,306,035 | B1 | 10/2001 | Kelly et al. | |
| 6,645,068 | B1 | 11/2003 | Kelly et al. | |
| 6,758,755 | B2 | 7/2004 | Kelly et al. | |
| 6,905,411 | B2 * | 6/2005 | Nguyen et al. | 463/25 |
| 7,025,674 | B2 | 4/2006 | Adams et al. | |
| 7,156,738 | B2 | 1/2007 | Rowe | |
| 7,322,885 | B1 * | 1/2008 | Luciano et al. | 463/17 |
| 7,452,270 | B2 * | 11/2008 | Walker et al. | 463/17 |

(Continued)

FOREIGN PATENT DOCUMENTS

| | | |
|---|---|---|
| WO | 03/073386 | 9/2003 |
| WO | 2005/029233 | 3/2005 |
| WO | 2009/002651 | 12/2009 |

OTHER PUBLICATIONS

International Search Report and Written Opinion mailed Dec. 4, 2008 for Application No. PCT/US2008/065124, 13 pages.

(Continued)

*Primary Examiner* — Pierre Eddy Elisca
*Assistant Examiner* — Shahid Kamal
(74) *Attorney, Agent, or Firm* — Weaver Austin Villeneuve & Sampson LLP

(57) ABSTRACT

Some preferred implementations of the invention provide a kiosk that can read a cashless instrument, determine one or more corresponding items of merchandise for which the cashless instrument may be redeemed and provide the corresponding item(s) of merchandise. The cashless instrument may be, for example, an ordinary "cash out" ticket, a ticket formed according to the invention, a player loyalty instrument, etc. Some implementations of the invention provide EGMs configured to issue cashless instruments that may be exchanged for various types of merchandise. The cashless instruments may be, for example, encoded tickets. Some implementations provide EGMs configured for encoding a prize code that indicates a corresponding item of merchandise for which the cashless instrument may be redeemed. However, a cashless instrument may or may not indicate a prize code. If a cashless instrument includes a prize code, the prize code may or may not be indicated in human-readable form.

39 Claims, 18 Drawing Sheets

U.S. PATENT DOCUMENTS

| | | | | |
|---|---|---|---|---|
| 7,618,317 | B2 * | 11/2009 | Jackson | 463/24 |
| 7,988,550 | B2 * | 8/2011 | White | 463/25 |
| 2001/0034259 | A1 | 10/2001 | Luciano et al. | |
| 2006/0068897 | A1 | 3/2006 | Sanford et al. | |
| 2006/0073883 | A1 | 4/2006 | Franks | |
| 2007/0275777 | A1 * | 11/2007 | Walker et al. | 463/16 |
| 2011/0183745 | A1 * | 7/2011 | Gagner et al. | 463/25 |

OTHER PUBLICATIONS

"Redemption game", Wikipedia online encyclopedia, Feb. 1, 2007, 2 pages.

"Cummins Kiosks", downloaded from the internet at http://www.cumminsallison.com/systems/ctk.htm, Jun. 15, 2007, 1 page.

"EDITH cashless gaming kiosk added to Casino Pauma" Sep. 2006, downloaded from the internet at http://www.selfserviceworld.com/article.php?id=16121 on Jun. 15, 2007, 2 pages.

International Preliminary Report on Patentability dated Dec. 22, 2009 from Application No. PCT/US2008/065124 (Publication WO 2009/002651).

* cited by examiner

| Prize Code 405 | Prize 410 |
|---|---|
| 1 | A, B or C |
| 2 | D or E |
| 3 | F or G |
| 4 | H |
| 5 | I |
| 6 | J |
| 7 | K |
| 8 | L |

400

Fig. 4A

412

| Ticket Value Range 415 | Prize 420 |
|---|---|
| $V_t < \$1$ | None |
| $\$1 \leq V_t \leq \$2$ | A or B |
| $\$2 < V_t \leq \$4$ | C or D |
| $\$4 < V_t \leq \$7$ | E |
| $\$7 < V_t \leq \$10$ | F |
| $\$10 < V_t \leq \$15$ | G |
| $\$15 < V_t \leq \$20$ | H |
| $V_t > \$20$ | I |

*Fig. 4B*

| Prize Value Range 425 | Prize 430 |
|---|---|
| *N/A* | None |
| $1.99 | A or B |
| $3.99 | C or D |
| $6 | E |
| $9 | F |
| $14 | G |
| $19 | H |
| $25 | I |

422

*Fig. 4C*

| Prize Value 435 | Prize 440 |
|---|---|
| $1 | A |
| $2 | B |
| $5 | C |
| $10 | D |
| $15 | E |
| $25 | F |
| $35 | G |
| $50 | H |

432

Fig. 4D

500

| Value Range 505 | Prize 510 |
|---|---|
| $V_t < 100$ | None |
| $100 < V_t \leq 200$ | A |
| $200 < V_t \leq 400$ | B |
| $400 < V_t \leq 700$ | C |
| $700 < V_t \leq 1000$ | D |
| $1000 < V_t \leq 1500$ | E |
| $1500 < V_t \leq 2000$ | F |
| More than 2000 | G |

*Fig. 5*

700

| Prize Value 705 | Prize 710 |
|---|---|
| 100 | A |
| 200 | B |
| 500 | C |
| 1000 | D |
| 1500 | E |
| 2500 | F |
| 3500 | G |
| 5000 | H |

Fig. 7

PRIZE REDEMPTION KIOSK

FIELD OF THE INVENTION

The present disclosure relates to devices, methods and networks involving wagering games.

BACKGROUND OF THE INVENTION

Gaming establishments are continually searching for new and innovative techniques to increase player patronage and profits, and to improve operations. (Although there are many types of gaming establishments, including casinos, cruise ships, riverboats, etc., all types of gaming establishments may sometimes be referred to herein as "casinos." Moreover, the term "casino" may be used to mean a particular gaming establishment, a group of associated gaming establishments and/or an entity that owns one or more gaming establishments.) A casino typically spends a great deal of time, money and effort in creating an attractive, exciting and distinctive environment. Marketing efforts may focus on both gaming and non-gaming features of the casino environment, the latter of which typically include entertainment venues, bars, restaurants, retail establishments, etc.

In recent years, it has become common for players to receive cashless instruments from an electronic wager gaming machine ("EGM"). Some such cashless instruments are in the form of tickets, such as a "cash out" ticket from an EZ Pay® system provided by IGT. Such a ticket may be used for credit in another EGM or may be taken to a cashier for redemption in cash. Other credits may be accrued pursuant to a player loyalty program. Such credits may be added, for example, for gaming sessions during which a player has inserted a player tracking card into a card reader of an EGM.

Although current uses of cashless instruments and player loyalty program credits are adequate, it would be desirable to provide more versatile and exciting methods and devices.

SUMMARY OF THE INVENTION

The present invention involves methods and devices for providing prizes, especially non-cash prizes, associated with wagering games. Some embodiments of the invention provide kiosks for dispensing non-cash and/or cash prizes. The kiosks may accept various indicia of credit in exchange for prizes, such as player loyalty points, cashless instrument credits, credit cards, debit cards and/or cash.

Some preferred implementations of the invention provide a kiosk that can read a cashless instrument, determine one or more corresponding items of merchandise for which the cashless instrument may be redeemed and provide the corresponding item(s) of merchandise. The cashless instrument may be, for example, an ordinary "cash out" ticket, a ticket formed according to the invention, a player loyalty instrument, etc.

Some implementations of the invention provide EGMs configured to issue cashless instruments that may be exchanged for various types of merchandise. The cashless instruments may be, for example, encoded tickets. Some implementations provide EGMs configured for encoding information on a cashless instrument (sometimes referred to herein as a "prize code" or the like) that indicates a corresponding item of merchandise for which the cashless instrument may be redeemed. However, a cashless instrument may or may not indicate a prize code. If a cashless instrument includes a prize code, the prize code may or may not be indicated in human-readable form.

Some embodiments of the invention provide a kiosk that includes the following elements: apparatus for determining cashless instrument information from a cashless instrument issued by a wager gaming machine; an indicator for indicating non-cash prizes to a player; apparatus for providing non-cash prizes; and a logic system. The logic system may be configured to determine whether a non-cash prize corresponds to the cashless instrument information and control the indicator to indicate whether a first non-cash prize corresponds to the player loyalty point information. The logic system may be configured to control the indicator to indicate the first plurality non-cash prizes when the logic system determines that a first plurality of non-cash prizes corresponds to the player loyalty point information.

The logic system may comprise at least one processor. The determining apparatus may comprise a ticket reader. The cashless instrument information may comprise a monetary value of the cashless instrument and/or a code that corresponds with a non-cash prize. The kiosk may include a display for a plurality of non-cash prizes. The providing apparatus may comprise a system for dispensing the non-cash prizes. The providing apparatus may comprise apparatus for receiving a user's selection of a non-cash prize, such as a button panel, a graphical user interface provided on a display device, a microphone and/or a dial. The indicator may comprise a display device and/or an audio device. The kiosk may include means for validating and/or voiding the cashless instrument.

The kiosk may also include a memory having a data structure stored therein, the data structure indicating non-cash prizes, corresponding cashless instrument information and/or corresponding non-cash prize monetary values. The corresponding cashless instrument information may, for example, comprise ranges of monetary values.

The logic system may be configured to do the following: determine a cashless instrument monetary value; determine whether there is a non-cash prize monetary value that is less than or equal to the cashless instrument monetary value; determine, when there is a non-cash prize monetary value that is less than or equal to the cashless instrument monetary value, a non-cash prize corresponding with the non-cash prize monetary value; calculate a monetary difference between the cashless instrument monetary value and the non-cash prize monetary value; and provide at least one indicium of value corresponding to the monetary difference.

The kiosk may also include apparatus for providing a message. If so, the logic system may be configured to do the following: determine a cashless instrument monetary value; determine a non-cash prize monetary value that is greater than the cashless instrument monetary value; determine a non-cash prize corresponding with the non-cash prize monetary value; calculate a monetary difference between the non-cash prize monetary value and the cashless instrument monetary value; and cause the message-providing apparatus to provide a message indicating that the non-cash prize could be obtained for the monetary difference.

The kiosk may also include apparatus for determining cashless instrument information from a cashless instrument issued by a wager gaming machine. If so, the logic system may be configured for determining whether a second non-cash prize corresponds to a combination of the player loyalty account information and the cashless instrument information. The logic system may be configured to control the indicator to indicate the second non-cash prize when the logic system determines that a second non-cash prize corresponds to the combination of the player loyalty account information and the cashless instrument information.

The logic system may be further configured to do the following: determine a monetary value of the cashless instrument; determine a range of monetary values that includes the monetary value of the cashless instrument; and determine whether a non-cash prize corresponds with the range of monetary values. When a non-cash prize corresponds with the range of monetary values, the logic system may be configured to control a speaker and/or a display device to offer the non-cash prize.

Some embodiments of the invention provide a device comprising apparatus for providing a wagering game and apparatus for issuing a cashless instrument in response to a wager gaming event. The device may comprise a wager gaming machine. The cashless instrument may comprise cashless instrument information that corresponds to a non-cash prize.

The issuing apparatus may be configured to print a message indicating the award of an unspecified prize in human-readable form on the cashless instrument. The issuing apparatus may be configured to indicate a specific prize in machine-readable form on the cashless instrument. The issuing apparatus may comprise a ticket printer. The wager gaming event may comprise a cash out event and/or a bonus event.

Some alternative implementations of the invention provide a kiosk, comprising: apparatus for determining player loyalty account information from a player loyalty instrument issued by a wager gaming machine; an indicator for indicating non-cash prizes to a player; apparatus for providing non-cash prizes; and a logic system. The logic system may be configured to do the following: determine player loyalty point information that corresponds with the player loyalty account information; determine whether a first non-cash prize corresponds to the player loyalty point information; and control the indicator to indicate whether a first non-cash prize corresponds to the player loyalty point information.

The indicator may comprise a display device, an audio device and/or a plurality of windows for displaying non-cash prizes or representations of non-cash prizes. The logic system may be further configured to control the indicator to indicate the first plurality of non-cash prizes when the logic system determines that a first plurality of non-cash prizes corresponds to the player loyalty point information. The logic system may comprise at least one processor. The determining apparatus may comprise a player loyalty card reader.

The kiosk may also include apparatus for determining cashless instrument information from a cashless instrument issued by a wager gaming machine. The logic system may be further configured for determining whether a second non-cash prize corresponds to a combination of the player loyalty account information and the cashless instrument information. The cashless instrument information may comprise a monetary value of the cashless instrument and/or a code that corresponds with a non-cash prize. The logic system may be further configured to control the indicator to indicate a second non-cash prize when the logic system determines that the second non-cash prize corresponds to the combination of the player loyalty account information and the cashless instrument information.

The kiosk may further comprise a memory having a data structure stored therein. The data structure may indicate non-cash prizes and corresponding non-cash prize monetary values, non-cash prizes and corresponding cashless instrument information and/or non-cash prizes and corresponding player loyalty point information.

The kiosk may also include apparatus for receiving a user's selection of a non-cash prize, such as a button panel, a graphical user interface provided on a display device, a microphone, a dial, or the like.

The logic system may be further configured to do the following: determine a combination value of the combination of the player loyalty account information and the cashless instrument information; determine whether there is a non-cash prize value that is less than or equal to the combination value; determine, when there is a non-cash prize value that is less than or equal to the cashless instrument value, a second non-cash prize corresponding with the non-cash prize value; calculate a value difference between the cashless instrument value and the non-cash prize value; and provide at least one indicium of value corresponding to the value difference. The value may be a monetary value and/or a player loyalty point value.

The logic system may be further configured to do the following: determine a combination value of the combination of the player loyalty account information and the cashless instrument information; determine a non-cash prize value that is greater than the combination value; determine a second non-cash prize corresponding with the non-cash prize value; calculate a value difference between the non-cash prize value and the combination value; and cause the indicator to provide a message indicating that the second non-cash prize could be obtained for the value difference. The value may be a monetary value and/or a player loyalty point value.

The present invention provides hardware that is configured to perform the methods of the invention, as well as software to control devices to perform these and other methods. For example, methods of this invention may be represented (at least in part) as program instructions and/or data structures, databases, etc. that can be provided on computer-readable media.

These and other features of the present invention will be presented in more detail in the following detailed description of the invention and the associated figures.

BRIEF DESCRIPTION OF THE DRAWINGS

FIGS. 4A, 4B, 4C, 4D and 5 are tables indicating simplified versions of data structures that may be formed and/or used according to some methods of the invention.

FIG. 7 is another simplified version of a data structure that may be formed and/or used according to some methods of the invention.

DESCRIPTION OF SOME EXAMPLES OF THE INVENTION

Figure 1A:
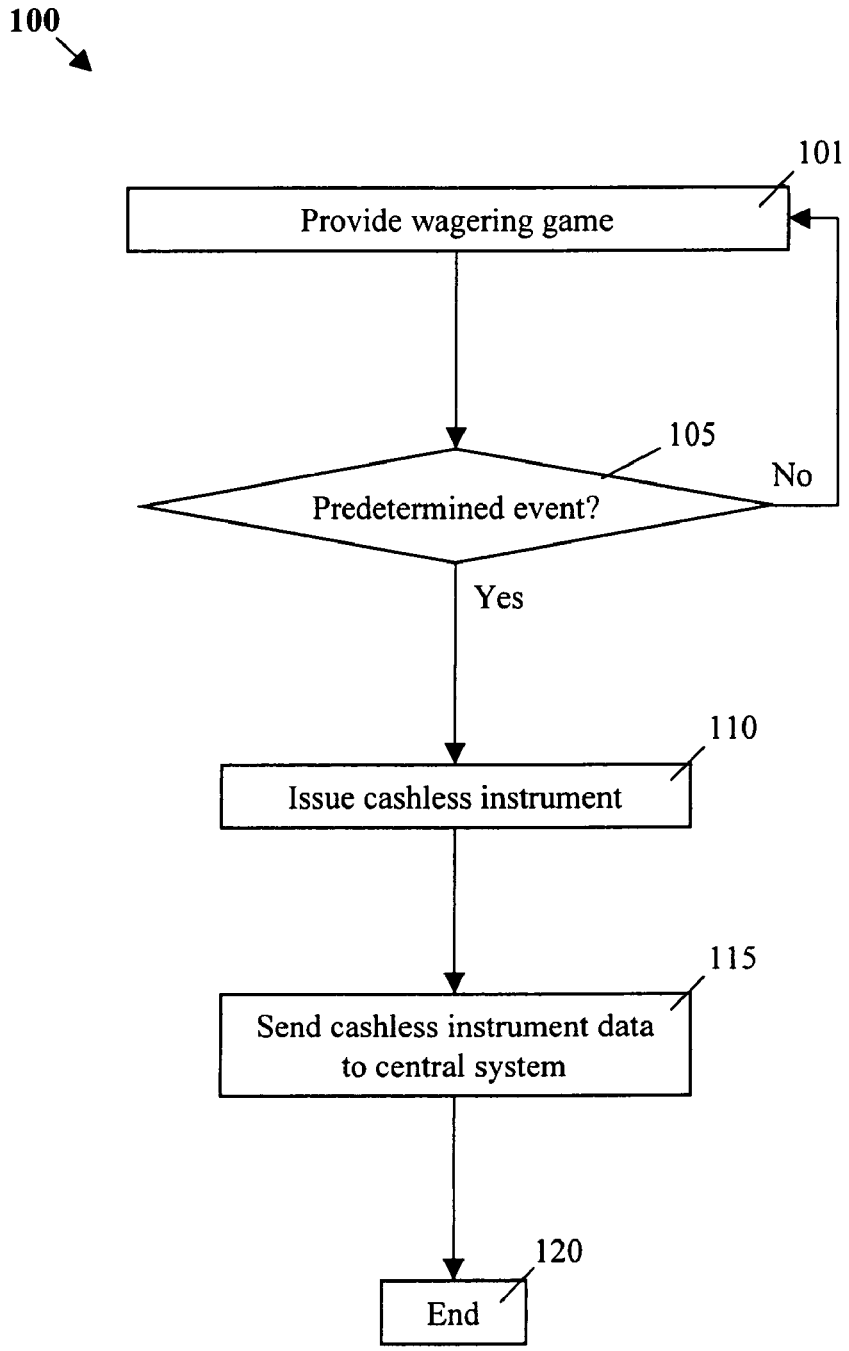
FIG. 1A is a flow chart that outlines some methods of the invention.

Reference will now be made in detail to some specific examples of the invention, including the best modes contemplated by the inventor for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, well-known process operations have not been described in detail in order not to obscure unnecessarily the present invention.

Various techniques and mechanisms of the present invention will sometimes be described in singular form for clarity. However, it should be noted that some embodiments include multiple iterations of a technique or multiple instantiations of a mechanism unless noted otherwise. For example, a system uses a processor in a variety of contexts. However, it will be appreciated that a system can use multiple processors can while remaining within the scope of the present invention unless otherwise noted.

Similarly, the steps of the methods shown and described herein are not necessarily all performed (and in some implementations are not performed) in the order indicated. Moreover, some implementations of the methods discussed herein may include more or fewer steps than those shown or described.

Furthermore, the techniques and mechanisms of the present invention will sometimes describe a connection between two entities. It should be noted that a connection between two entities does not necessarily mean a direct, unimpeded connection, as a variety of other entities may reside between the two entities. For example, a processor may be connected to memory, but it will be appreciated that a variety of bridges and controllers may reside between the processor and memory. Consequently, an indicated connection does not necessarily mean a direct, unimpeded connection unless otherwise noted.

The present invention generally involves methods and devices for providing prizes associated with games of chance. Some embodiments of the invention provide kiosks for dispensing non-cash and/or cash prizes. The kiosks may accept various indicia of credit in exchange for prizes, such as player loyalty points, cashless instrument credits, credit cards, debit cards and/or cash.

Some kiosks of the invention allow different types of credit indicia to be combined towards the value of a prize. For example, a kiosk may allow a player to combine credit from a cashless instrument with player loyalty points and/or cash in order to obtain a prize. In some such implementations, a patron may be prompted to provide additional indicia of credit for a more valuable prize, i.e., for a prize that requires more credit than is indicated on a cashless instrument and/or more player loyalty points than the patron has made available from a player loyalty account. If necessary, various indicia of credit may be converted into common units, which may be monetary units, player loyalty points or other units defined by the kiosk or prize system.

Referring now to FIG. 1A, method 100 of the invention will now be described. In step 101, a wagering game is provided. In this example, step 101 is performed, at least in part, by an EGM. However, the wagering game may also be provided by other means, e.g., via a networked table game.

In step 105, it is determined whether a predetermined event has occurred. The event may be, for example, a bonus event related to awarding some type of prize. The bonus event may be triggered according to any method known in the art, e.g., according to an event of the wagering game, a wagering threshold, a player loyalty point threshold, a random event, etc. One such event may be a positive determination of a random number generator according to a bonus award frequency applicable to the player.

Some types of events may only happen at predetermined times (e.g., during a themed event such as NASCAR® weekend, Harley Davidson® night, etc.), under predetermined conditions (e.g., only when a player is playing "Max Bet" or the like) and/or for predetermined players. For example, some bonus events and/or prizes may only be available to players of a player loyalty program, to players at a predetermined level of the player loyalty program, etc.

The odds of a predetermined event may vary. For example, the odds of a bonusing event may be greater for relatively higher-level members of a player loyalty program. In some implementations, the magnitude of a bonus award may also be based on a player's rank in a player loyalty program. For example, a gold-level player might be awarded a prize worth $10 for the same event that would cause a silver-level player to be awarded a prize worth $8.

The conditions for obtaining and redeeming prizes may vary and are preferably configurable, e.g., by a gaming establishment. For example, a casino may determine that a prize will be awarded upon the occurrence of events associated with a particular gaming session. For example, a prize may be awarded after a player has wagered (or lost) a predetermined amount of money, when a gaming session has lasted for a predetermined amount of time, etc. A prize may be awarded to celebrate a significant win by the player or by another player.

Alternatively, or additionally, a prize may be awarded according to information about the player that may be, e.g., stored in a database of a player loyalty program. For example, a player may be awarded one or more prizes on the player's birthday, wedding anniversary, etc. (E.g., "Hey, it's your birthday today! Here's a prize for you!")

A prize may be awarded upon the occurrence of other events, which may or may not be casino-defined. For example, a prize could be awarded according to the occurrence of predetermined events of a wagering game, e.g., four-of-a-kind with a specified card, a number of specified symbols on a payline, etc.

However, the predetermined event may not always be a bonus event or the like. For example, the predetermined event may simply be an indication that a player has finished a gaming session. Such an event may be, e.g., an indication that a player has activated a "cash out" button or the like, an indication that the player seeks to remove (or has removed) a player loyalty instrument such as a player tracking card, an indication that the player's credit is zero, an indication that the player has not responded within a predetermined time, etc.

If no predetermined event takes place, the wagering game continues. However, in this example, when a predetermined event takes place, a cashless instrument is issued by the EGM. (Step 110.) Preferably, data regarding the cashless instrument are transmitted to a central system via a gaming network, e.g., as depicted elsewhere herein. (Step 115.) Such data may include some or all of the data described below with reference to FIGS. 1B and 1C. The central system may retain these data to ensure that only valid cashless instruments are redeemed, that they are only redeemed once, to provide an audit trail, etc.

Figure 1B:
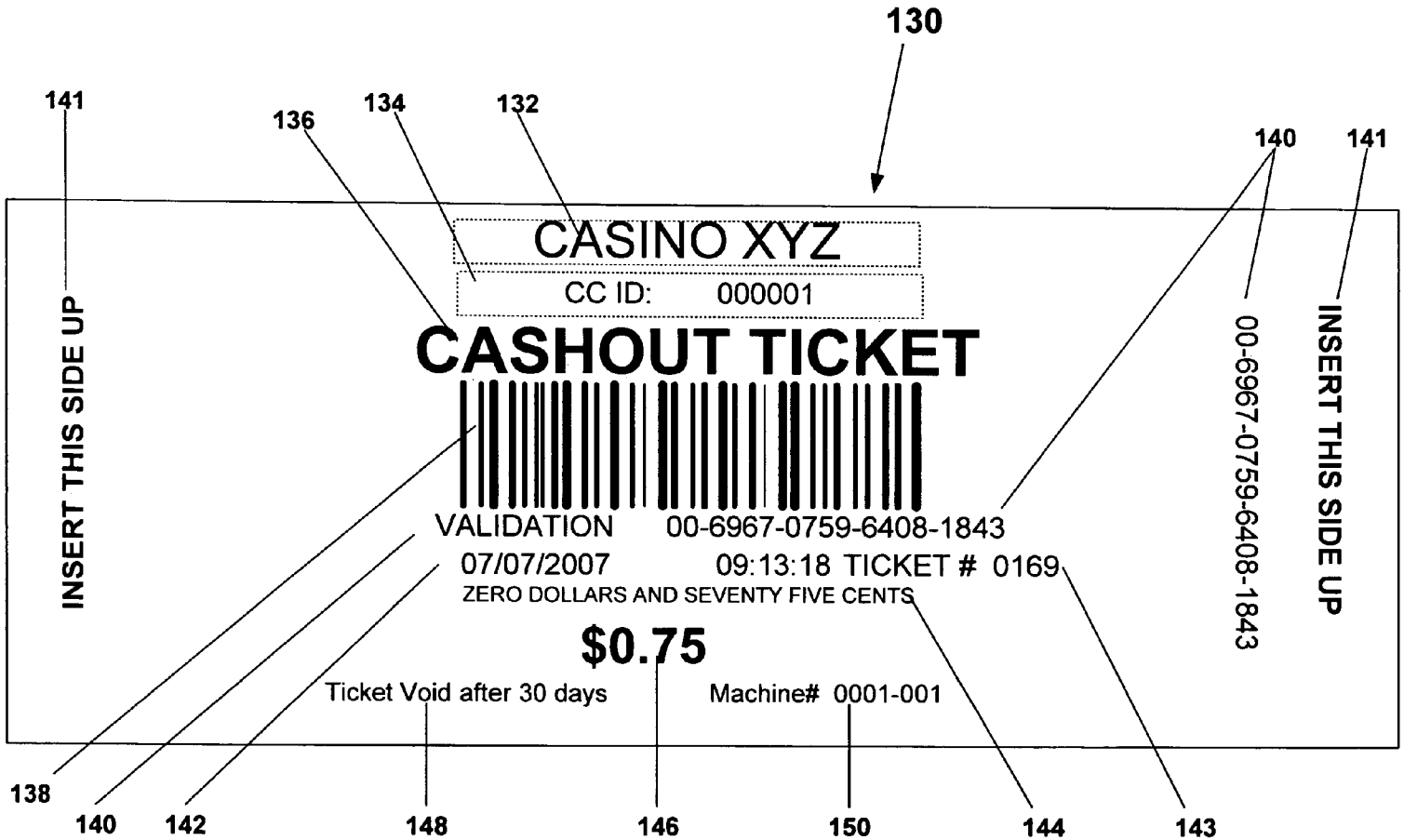
FIGS. 1B and 1C depict examples of cashless instruments that may be provided and/or used according to some methods of the invention.
Figure 1C:
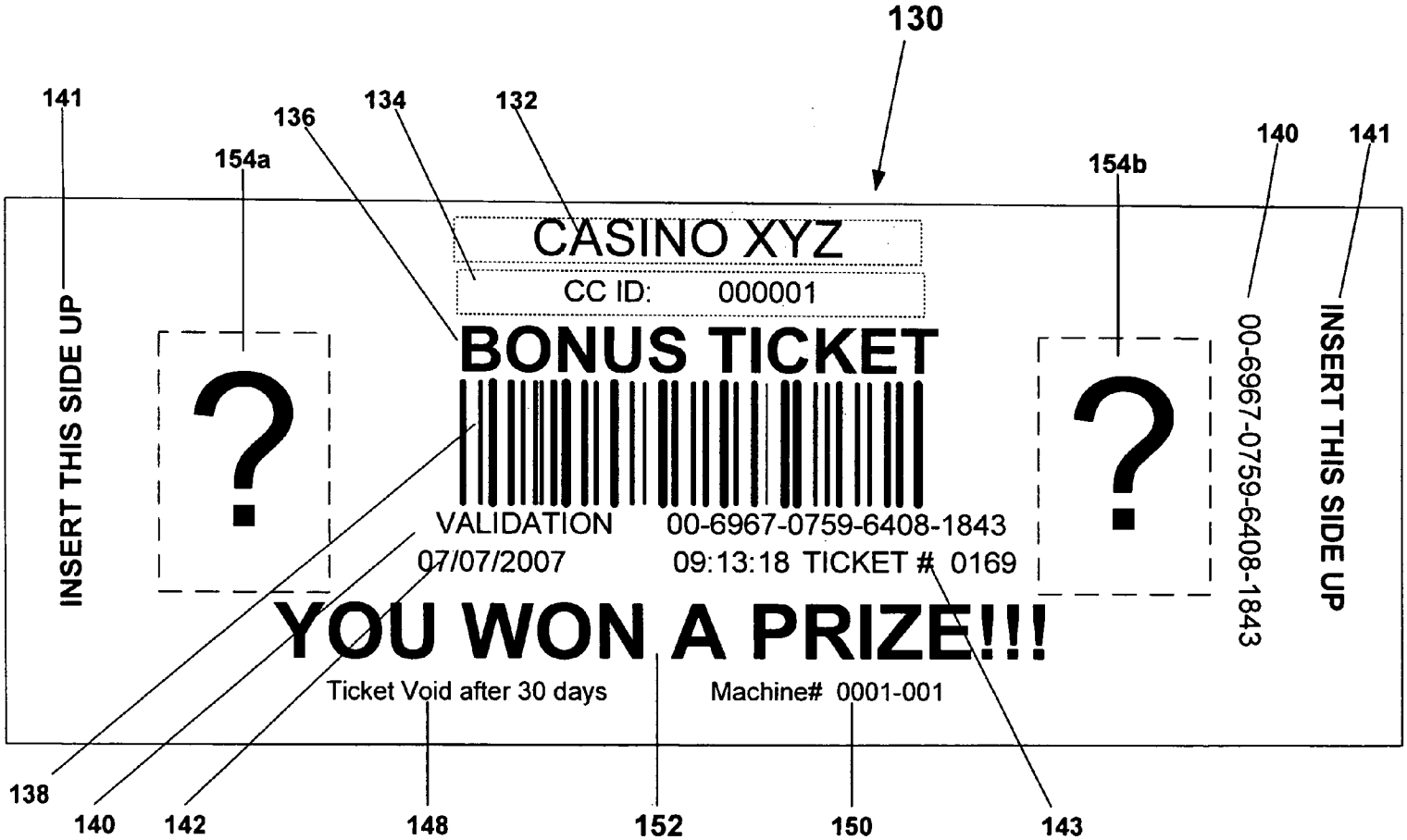

The cashless instrument issued in step 110 may take any one of many different forms. One simple form is a paper or plastic ticket having various types of information printed thereon. FIGS. 1B and 1C present examples of some components of such printed tickets. It will be appreciated that other formats, materials, information, etc., may be used within the scope and spirit of the invention. For example, the cashless instrument may comprise data stored in a portable storage device, such as a memory of a USB dongle or the like, a personal digital assistant, a cellular telephone, etc.

In some embodiments of the invention, the format of the ticket may be generated from a template stored within a printer (e.g., a thermal printer as described elsewhere herein). The printing templates allow parameter values sent from the master gaming controller, from another source of game logic on a gaming machine or from another device (such as a server) to be printed in the format of a ticket voucher, a receipt or some other format.

As indicated on FIG. 1B, examples of parameter values that may be printed (or otherwise encoded) on a cashless instrument include, but are not limited to, the following: 1) an establishment 132; a location 134 (e.g. city, state and zip code); 3) a ticket type 136 (e.g. cashout, receipt, duplicate, duplicate receipt, bonus etc.); 4) a bar code 138; 5) a ticket validation number 140; 6) issue date and time 142; 7) a ticket number 143; 8) a textual ticket value 144; 9) a numerical ticket value 146; 10) an expiration date 148; and 11) a machine number 150. In addition, pre-printed graphics or text, e.g., "INSERT THIS SIDE UP" indication 141, may be printed on each ticket. Note that codes other than validation number 140 and/or bar code 138 may be formed on a cashless instrument.

As explained below, some cashless instruments may include a radio frequency identification ("RFID") tag or other transponder device. Some such cashless instruments include a passive RFID tag embedded in the cashless indicator. A passive radio-frequency identification tag includes an antenna (e.g., a coil of wire) and logic (e.g., a simple microchip) for responding to an RF interrogation or "probe" signal with a reply signal containing a unique identifier associated with the tag. When in proximity of an interrogation signal, the RFID uses a small amount of the electromagnetic energy it receives to power the logic and broadcast its identifier. Thus, the passive RFID requires no battery or other active power source.

Various mechanisms can be used to provide for authentication, anti-counterfeiting, and/or tracking of cashless instruments. One sophisticated and secure technology employs a transponder (e.g. an RFID tag) that can reply to an external probe with a signal identifying it. Because such transponders are embedded in the cashless indicator, they also identify the indicator itself. Transponders can respond to various types of probes including electromagnetic radiation, magnetic fields, electrical fields, chemical signals, and the like depending upon design. Bar codes, watermarks, and/or printed identifiers (numbers, signatures, pictures, fingerprints) provide other mechanisms. In this regard, related information is provided in U.S. Pat. No. 6,905,411, titled "PLAYER AUTHENTICATION METHOD FOR GAMING MACHINE VOUCHERS", naming Nguyen and Paulsen as inventor, and filed Feb. 27, 2002, and in U.S. patent application Ser. No. 10/926,636, filed on Aug. 25, 2004 and entitled, "METHODS AND DEVICES FOR GAMING ACCOUNT MANAGEMENT," both of which are incorporated herein by reference for all purposes.

Some cashless instruments provided according to the invention indicate a specific prize in machine-readable form. The prize may or may not be indicated in human-readable form. For example, a ticket may indicate, "CONGRATULATIONS! YOU HAVE WON A PRIZE!" or the like. However, the patron may not be able to determine what prize he or she has won until the ticket is read by a kiosk of the invention.

FIG. 1C indicates one example of such a ticket. Here, ticket type field 136 indicates that the ticket is a bonus ticket and field 152 indicates that a player has won a prize. The prize type may expressly encoded on the ticket, e.g., via bar code 138, as part of ticket number 143, etc. Such a code is sometimes referred to herein as a "prize code" or the like. As discussed elsewhere herein, some kiosks provided according to the present invention are configured to read a prize code and to determine corresponding item(s) of merchandise for which a cashless instrument may be redeemed. Alternatively, or additionally, a kiosk may associate one or more prizes with a cash value of the ticket.

However, as in this example, some tickets provided according to the invention do not indicate what prize the player has won in human-readable form. Accordingly, fields 154*a* and 154*b* indicate a tantalizing question mark, to heighten the player's interest. In alternative embodiments, a prize may be indicated on a cashless instrument via text and/or graphics, e.g., in field 154*a* and/or field 154*b*.

Tickets indicating a bonus award may be generated in response to a specific bonus event identified in the game logic and/or a random event not directly connected with a displayed bonus game. In the later case, one embodiment involves providing random (or selected) tickets in a fold of blank printable tickets with preprinted indicia of the bonus award. When a ticket is printed with indicia of a "primary award" (from a winning event or an ordinary cash out event), the ticket may or may not also contain indicia of the bonus award. In some such embodiments, at the time of issuance the bonus award indicia are preprinted on the back of a ticket, while the primary award indicia are printed on the front side of the ticket. Alternatively, the bonus award indicia may not be preprinted on any tickets, but instead may be printed at the time the tickets are issued. Moreover, the bonus award indicia and the primary award indicia may be printed on the same side of a ticket.

Some implementations of the invention give a player the option of either cashing out for the credit balance or for an unknown prize, which may be a cash prize or a non-cash prize. The value of the prize may be greater than or less than the alternative cashout value of the ticket. For example, when the player activates a "Cash Out" button (or the like), the player may be prompted that there is another option, e.g.:

> "Feelin' Lucky? Touch the screen here [indication] if you want to try for a bonus prize instead of receiving your balance of [credit balance]!"

This option may particularly appeal to players who would otherwise receive a relatively small cashout value or to players who have a strong desire to receive one or more of the prize(s). However, the possible prize(s) may or may not be indicated in the prompt.

If the player decides to try for the bonus prize(s), a logic system (e.g., a processor and/or a random number generator) of the EGM will determine the result. The logic system may refer to a data structure to determine the probabilities corresponding to various outcomes. The odds of winning a more valuable prize (in other words, a prize that is more valuable than the "cash out" that the player would otherwise have received) may vary. For example, the odds may improve for relatively higher-level members of a player loyalty program.

In some such implementations, the result will be indicated on a cashless instrument of some type, e.g., on a ticket. As with other implementations, the ticket may or may not indicate the outcome in human-readable form. The patron may not be able to determine what prize he or she has won until the ticket is read by a kiosk of the invention.

Some implementations of the invention provide a kiosk that can read a cashless instrument, determine one or more corresponding items of merchandise for which the cashless instrument may be redeemed and provide the corresponding item(s) of merchandise. The cashless instrument may be, for example, an ordinary "cash out" ticket, a ticket formed according to the invention, a player loyalty instrument, etc. As noted elsewhere, such a kiosk may also be configured to accept other indicia of credit, including but not limited to currency, credit cards, debit cards, payment signals from a cellular telephone or other device, etc.

Figure 2:
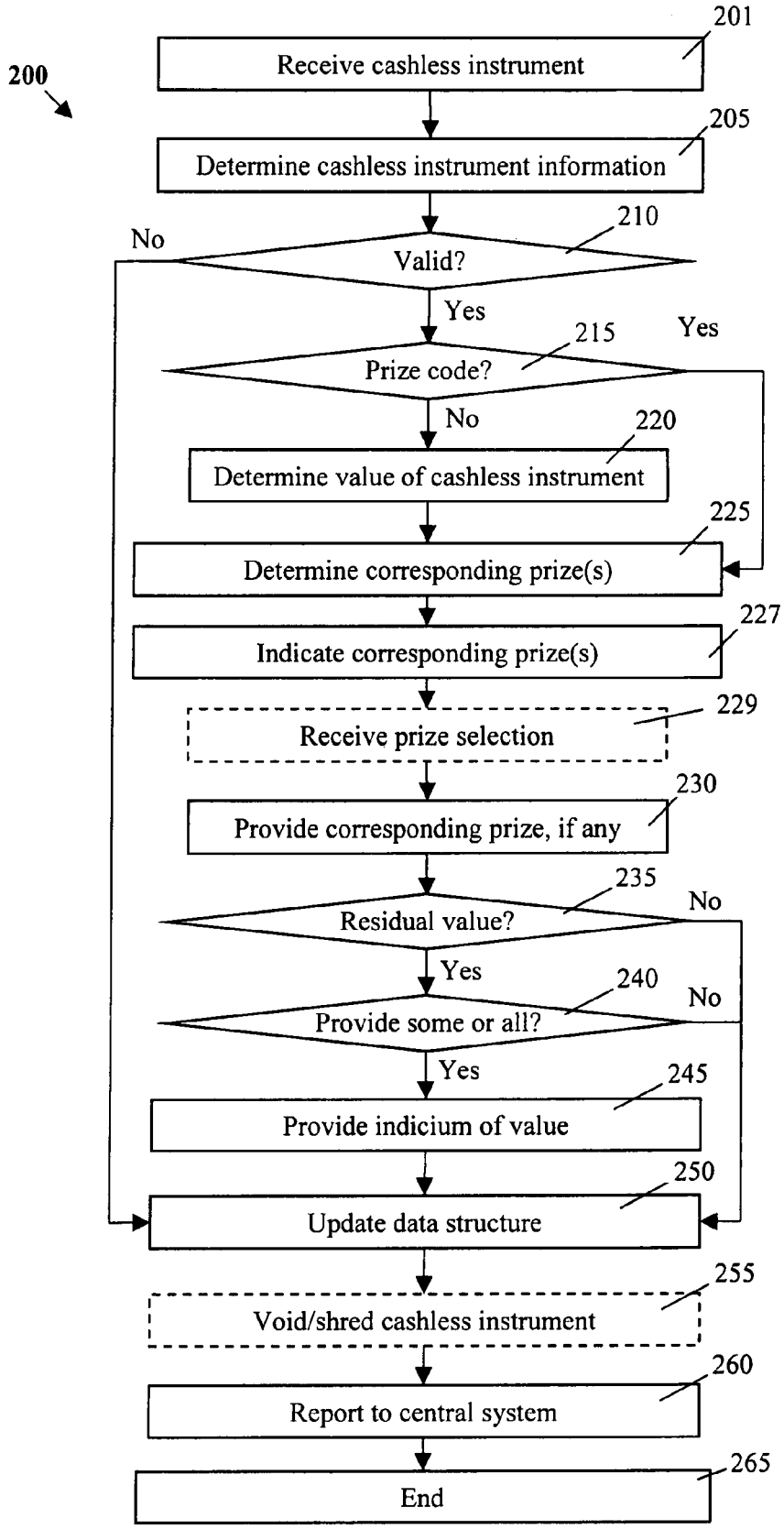
FIG. 2 is a flow chart that outlines alternative methods of the invention.

FIG. 2 is a flow chart that outlines a method 200 that may be performed, for example, by some kiosks of the present invention. Accordingly, the steps will be described as performed by a kiosk. However, in alternative implementations of the invention, other devices (such as gaming machines, vending machines, etc.) could perform some or all of the steps indicated.

In step 201, the kiosk receives a cashless instrument. As noted elsewhere, the cashless instrument could take many forms. In this example, the cashless instrument is a ticket, e.g., such as that described with reference to FIGS. 1B and 1C. Accordingly, a ticket reader of some type, such as a bar code reader, an RFID reader, etc., may read data from the cashless instrument. (Step 205.) Some of this information may be used to perform a validity check, e.g., by transferring a ticket validation number to a server configured for cashless instrument validation/authentication. (Step 210.) If the cashless instrument is valid, the process continues to step 215. A server (or the like) will preferably update a cashless instrument database to indicate that the ticket has been redeemed.

As noted elsewhere, some tickets will include a prize code of some type. Therefore, in this example, a logic system of the kiosk determines whether a prize code has been read from the ticket. (Step 215.) If so, the logic system will determine one or more corresponding prizes according to the prize code. (Step 225.) The logic system may include, for example, one or more processors, programmable logic devices, etc.

In determining what prize to offer and/or provide, the logic system may reference a data structure of some type. Table 400 of FIG. 4A is a simplified version of such a data structure, which maps values in prize code field 405 to one or more corresponding values in prize field 410. Table 400, as with other tables indicated herein, provides merely one example of the numbers of fields, types of fields, numbers of elements per field, etc., that may be used to implement various aspects of the invention.

In this example, if the logic system determined that a type "1" prize code were indicated on the cashless instrument, the logic system would determine that one of corresponding prize types A, B or C should be provided. If, as in this example, more than one prize type corresponds with a prize code, the logic system may cause a prompt to be made on a display device, via an audio device, etc. (step 227), so that a user may choose between multiple prize types. (Step 229.)

In this example, a type 1 prize code corresponds with the lowest-level prizes. For example, a type A, B or C prize may be something with a value comparable to that of a key chain, a pen, a cap, etc. In some preferred implementations, the specific prizes are configurable, e.g., by the gaming establishment.

In some implementations of the invention, prizes may be "branded" in one or more ways. For example, a logo or other image that is associated with a casino may appear on the prize. In one such example, a kiosk deployed in the MGM Grand® casino may provide one or more shirts, caps, drinking glasses, cups, dongles or other prizes displaying an image of the Metro-Goldwyn Mayer lion. Caesar's Palace may wish to use images of the Colosseum of Rome, Caesar's head, a Roman figure in a toga, etc.

Similarly, the prize may be a physical representation of such a logo or image. For example, a kiosk deployed in the MGM Grand® casino may provide a toy MGM lion. A kiosk deployed at the Luxor® casino might dispense a toy pyramid, a Sphinx or other Egyptian-themed paraphernalia. The MGM/Mirage might have a New York, N.Y. theme wherein prizes include a toy Statue of Liberty, a toy Empire State Building, toy hubcaps, etc.

A prize may be associated with a particular type of game. For example, a prize for a playing card game such as video poker may include a representation of a playing card symbol such as a heart or a diamond. A prize could be associated with a game theme, e.g., Darth Vader's image or head could appear on a prize for a Star Wars® game. Alternatively, or additionally, the collectible may be associated with a game producer and/or a gaming machine manufacturer, such as a spade collectible for IGT.

Returning to FIG. 2, if it is determined in step 215 that the cashless instrument does not have a prize code, the value of the cashless instrument is determined in step 220. In some instances, the cashless instrument will have an associated monetary value. For example, the cashless instrument may be an ordinary cash out ticket. In other instances (discussed in more detail below), the cashless instrument will have other associated credits, e.g., some type of points. The points may, for example, correspond to those of a player loyalty program. Alternatively, the points may be specific to prizes that may be awarded according to the invention.

If the cashless instrument has an associated monetary value, the corresponding prize(s) may be determined in a number of ways. For example, the corresponding prize(s) may be determined by reference to a data structure of the general type shown in FIG. 4B. In table 412, monetary value ranges 415 have corresponding prizes 420. In this example, if the monetary value $V_t$ of the cashless instrument is below a predetermined threshold value (one dollar in this example), a logic system of the kiosk will determine that there is no associated prize. (Step 225.) This fact will be indicated to the player in step 227.

As described in more detail below, in some implementations of the present invention a patron will be prompted to input additional indicia of credit when a cashless instrument does not indicate sufficient credit for a prize. Here, for example, if the monetary value $V_t$ of the cashless instrument is less than $1, the player may be prompted to provide additional monetary credits, e.g., by inserting cash, a credit card or a debit card, by sending a signal from a cellular telephone or other payment device, etc., in order to obtain some type of prize. Alternatively, the player may be able to provide other types of credits, such as player loyalty points. If the player provides no additional credit, no prize will be provided in step 230.

In this example, some monetary value ranges correspond to more than one type of prize. Here, if the monetary value $V_t$ of the cashless instrument is at least $1 and not more than $2, the kiosk's logic system will determine corresponding prize type A and prize type B. (Step 225.) One or both of these prizes will be offered. (Step 227.) However, if $V_t$ is at least $4 and not more than $7, the kiosk's logic system will determine corresponding prize type E. (Step 225.) Only prize type E will be offered. (Step 227.)

In step 229, a prize selection may be received by the kiosk. (Various possible mechanisms for presenting prizes and receiving prize selections will be discussed below with reference to kiosk 800 of FIG. 8.) For example, if a player has been offered multiple prize options in step 227, the player's selection may be received in step 229. In other implementations, a single prize will be offered in step 227 and the player's selection will be whether or not to accept the prize.

As noted elsewhere herein, the order of steps of this invention may differ from the order of the steps of flow charts provided herein. Accordingly, in other implementations, the player will have previously made a prize selection and the selected prize will be provided if the player has provided sufficient credit for the selected prize. In some such examples, step 225 may comprise determining whether the cashless instrument indicates at least enough credit required for the selected prize. For example, a player may wish to have prize type G, even though the player's cashless instrument has enough credit for prize I, e.g., has a monetary value of $25. Some implementations of the invention allow a player to select such lower-value prizes.

For various reasons, it may often be the case that a player has provided a cashless instrument that has more credit than is required for a selected prize. Such credit will sometimes be referred to herein as a "residual value" or the like. In step 235, it will be determined whether there is a residual value of the cashless instrument.

If there is a residual value of the cashless instrument, a separate determination may be made as to whether any of the residual value will be provided to the player. (Step 240.) This determination may be made, e.g., according to a rule set implemented by software executed by the logic system of a kiosk. The rule set is preferably configurable.

Some rule sets may cause the residual value to be provided only in certain circumstances. For example, the residual value may be provided only when the monetary value of the cashless instrument is within one or more predetermined ranges. One such rule set, intended for use with a data structure such as table 412, provides the residual value only when the monetary value of the cashless instrument is less than $1, is greater than a predetermined threshold (e.g., more than $25) or when no prize is provided. For example, if the monetary value of the cashless instrument were $7.53 and the player were to accept prize F, the player would not receive any "change" or other indicium of value. However, if the monetary value of the cashless instrument were $0.53 and the player did not provide additional credit, the player would receive an indicium of value, such as $0.53 in currency, a credit to a player loyalty account, another cashless instrument with a $0.53 credit, etc. (Step 245.)

In some implementations, each prize type may have a corresponding monetary and/or other value $V_p$, in order to provide a method of determining the whether there is a residual value and, if so, how much to provide. The value of $V_p$ is preferably configurable and need not precisely correspond with the value of $V_t$.

One such example will now be described with reference to table 422 of FIG. 4C. The values indicated in prize value range field 425 are the values of $V_p$ corresponding with the prizes indicated in FIG. 4B. Returning to the example of the cashless instrument having a monetary value of $7.53, the player would be entitled to prize F, as before. (See FIG. 4B.) As before, the player would not receive any "change" or other indicium of value because the value of $V_p$ corresponding with prize F is $9. Because $V_p > V_t$, the player would not be entitled to receive any indicium of value. However, if the player's cashless instrument were to have a monetary value of $9.53, then $V_p$ would be less than $V_t$. Therefore, the player would be entitled to receive prize F and an indicium of credit valued at $0.53, e.g., $0.53 in change.

In some implementations of the invention, the value required to obtain a prize is the same value used in determining and calculating the residual value of a cashless instrument. One such implementation will now be described with reference to table 432 of FIG. 4D. Returning to the example of the cashless instrument having a monetary value of $7.53, the player would be entitled to prize C. In some implementations of the invention, the player may be informed that he or she is also entitled to prize B or prize A. However, if the player were to select prize C, the player would be provided with prize C (step 230) and with indicia of credit worth $2.53 (step 245).

Whether or not any residual value has been provided, one or more data structures should be updated in order to maintain a record of the transaction. (Step 250.) The data structures may reside in a local memory (e.g., a memory of the kiosk) or in a memory of another device in communication with the kiosk (e.g., a memory of a server, a network storage device, etc.).

As noted elsewhere herein, the steps of the methods shown and described herein are not necessarily all performed in the order indicated. Accordingly, the updating step may take place, at least in part, after a report of the transaction is made to a central system. (Step 260.) In some preferred implementations, the cashless instrument will be voided and/or shredded. (Step 255.) The shredding and/or voiding step may occur at various stages in the process, according to the implementation.

Some implementations of the invention involve prompting to input additional indicia of credit than are indicated by a cashless instrument. In the foregoing example, the player could be prompted to input additional indicia of credit if the player desires a prize valued at more than $7.53, such as prize D or E.

Figure 3:
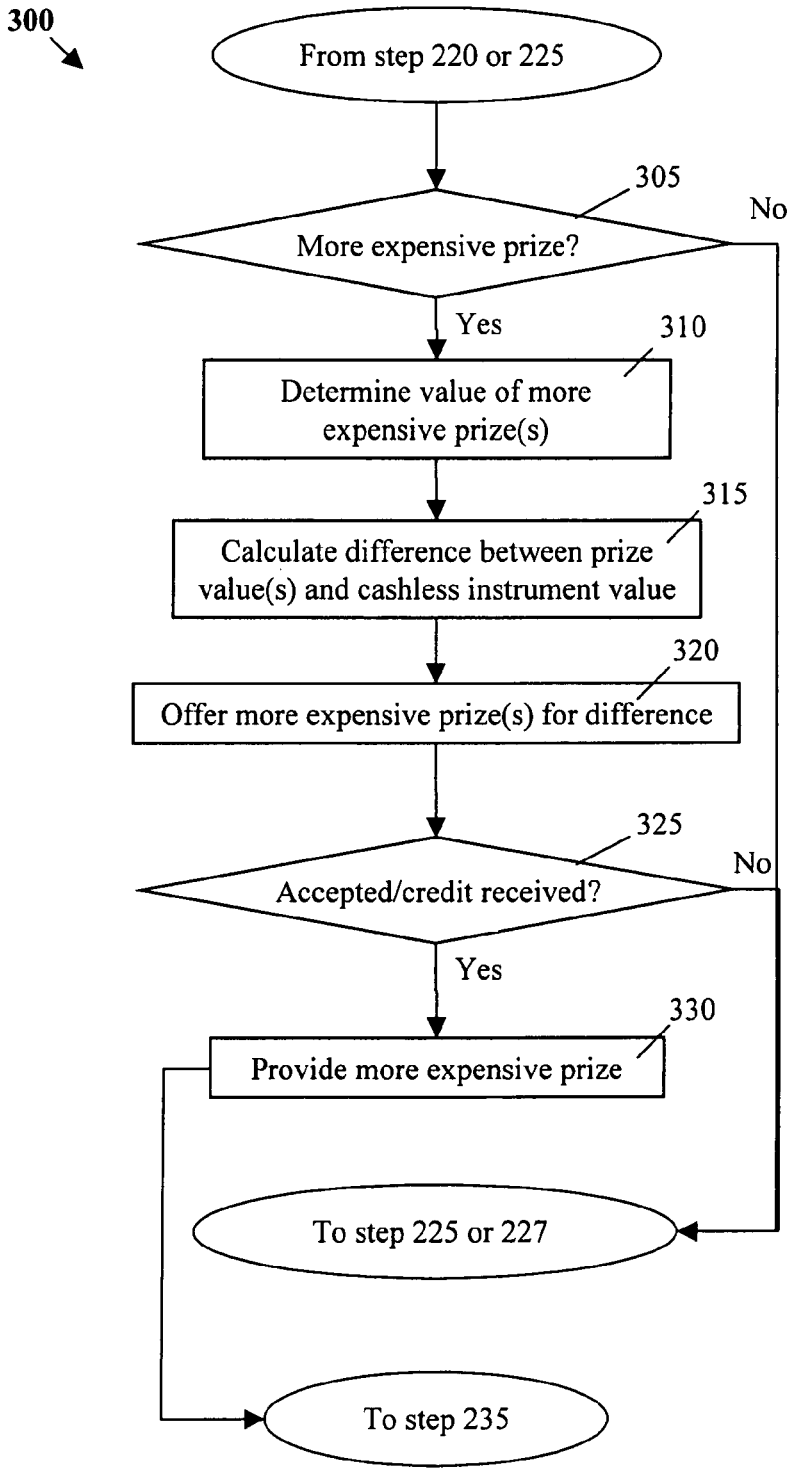
FIG. 3 is a flow chart that outlines other methods of the invention.

FIG. 3 provides an overview of one such method of the invention. In this example, method 300 begins after step 220 or step 225 of method 200. However, the general method is not limited to following these steps and may be applied in many other contexts. In this example, the method begins after a kiosk has determined a value of a cashless instrument, and either before or after the kiosk has determined what prize(s) correspond to that value.

In step 305, the kiosk determines whether the cashless instrument value is less than that of the at least one type of available prize (a "more expensive prize"). If there is no more expensive prize, the process continues according to the appropriate step of method 200. For example, referring again to the example of FIG. 4D, if the cashless instrument value were $50 or more, the process would continue to step 225 or step 227 of method 200.

However, if there were at least one more expensive prize, the value of the prize(s) would be determined (step 310). In some implementations, only the value of the more expensive prize closest in value to that of the cashless instrument is determined. However, in alternative implementations, the values of multiple prizes may be determined. The difference between the prize value(s) and the cashless instrument value(s) may then be determined (step 315), and the more expensive prize(s) will be offered for the difference(s). (Step 320.)

The value determination may be made in various ways. In some implementations, monetary values will be determined. Referring again to FIG. 4D, if the value of the cashless instrument were $27.50, it would be determined whether prize G were available and possibly whether prize H were available. According to implementations wherein both prizes would be considered, if both prize G and H were available, the prize values could be determined by reference to data structure 432. The differences in value would be determined to be $7.50 and $22.50, accordingly.

A user could be prompted, e.g., as described below with reference to FIG. 8, to insert indicia of credit for the difference to obtain one of these prizes. If the user selected one of the more expensive prizes and provided at least the required amount of credit (as determined in step 325), the more expensive prize would be provided. (Step 330.)

However, in some implementations of the invention, prizes may be valued according to units other than monetary value. In such implementations, other types of points and/or credits may be used to obtain prizes. These points or credits may be related to a gaming establishment, to a game theme, to a special event, etc.

In some such implementations, these points or credits may be encoded on some form of cashless instrument. Accordingly, the cashless instrument may be processed substantially as described above with reference to FIGS. 2 and 3. For example, step 220 may involve determining the points or credits indicated on the cashless instrument.

A kiosk (or the like) may determine prizes that correspond with these points or credits by referencing one or more data structures. Table 500 of FIG. 5 is a simple example of one such data structure. In this example, ticket value ranges 505 indicate the number of points required to obtain the corresponding prizes 510. In this example, at least a threshold number of points are required to obtain the lowest-level prize: here, at least 100 points are required to obtain prize type A. However, if the cashless instrument were to have a value $V_t$ of, e.g., 1200 points, the cashless instrument could be redeemed for prize type E. As described above, some such implementations will provide residual value to a user and others will not. Other prizes, of higher or lower value, may be offered.

In some implementations of the present invention, points of a player loyalty program may be used to provide at least part of the credit necessary to obtain prizes from a kiosk or the like. Some such implementations allow player loyalty points to be used to provide additional credit for a "more expensive prize" instead of (or in addition to) monetary credit or other indicia of credit. The value of the more expensive prize(s) in player loyalty points (or other indicia of credit) may be determined, e.g., in step 310 of method 300.

For example, suppose that a player had previously inserted a cashless instrument having a monetary value of $22.75 into a kiosk. Referring in this example to FIG. 4D, that cashless instrument would entitle the player to prize E. The player may be prompted to provide additional credit if the player would like to obtain prize F, G or H. If the player were to select prize G, the player may be asked to provide $12.25 in monetary credit. In this example, the player would also have the option of providing the additional credit via player loyalty points, if the player had enough of them in his or her account.

Alternative methods of using player loyalty points will now be described with reference to FIG. 6. As with other methods of the invention, the steps of method 600 may be performed, at least in part, by a logic system of a kiosk or the like. The logic system may include one or more processors, programmable logic devices, etc. As described elsewhere herein (e.g., with reference to FIGS. 8 and 9), the kiosk is preferably configured for communication with a player loyalty system, e.g., via some type of network interface.

Method 600 starts with the determination of a player loyalty account. (Step 601.) This determination may involve reading a player loyalty instrument, such as a player tracking card. Such a player loyalty instrument may be read by reading a magnetic strip on a card, by reading a radio frequency identification ("RFID") tag, by communicating with a universal serial bus ("USB") dongle, or via other any methods and/or devices known by those of skill in the art. The determination of step 601, or a related authentication step, may involve receiving a code, a password, or the like from a user, e.g., via a keypad. Other authentication steps may be required, such as the verification of biometric data (such as fingerprint data, retinal scan data, voice data, etc.) obtained from the user.

After the player loyalty account has been determined, data structures associated with the account may be accessed. The number of available player loyalty points in the account may be determined. (Step 605.) Player preference data may also be determined, if any relevant data are available.

In step 610, one or more corresponding prizes are determined. This determination may be made in various ways, according to the implementation. If player preference data indicate preferred types of prizes, step 610 may involve determining whether there are sufficient player loyalty points for a prize that may be of interest to the player. One or more data structures, e.g., of the type indicated in FIG. 5 or FIG. 7, may be referenced to determine one or more prizes that correspond with numbers of player loyalty points.

In step 615, one or more prizes will be offered. In some implementations, the corresponding number of points will also be indicated. For example, selected prizes may be offered, along with corresponding points, in a display device of a kiosk. (See, e.g., FIG. 8.) Alternatively, or additionally, the required number of credits (points and/or monetary credits) may be displayed near some or all prize displays.

Figure 6:
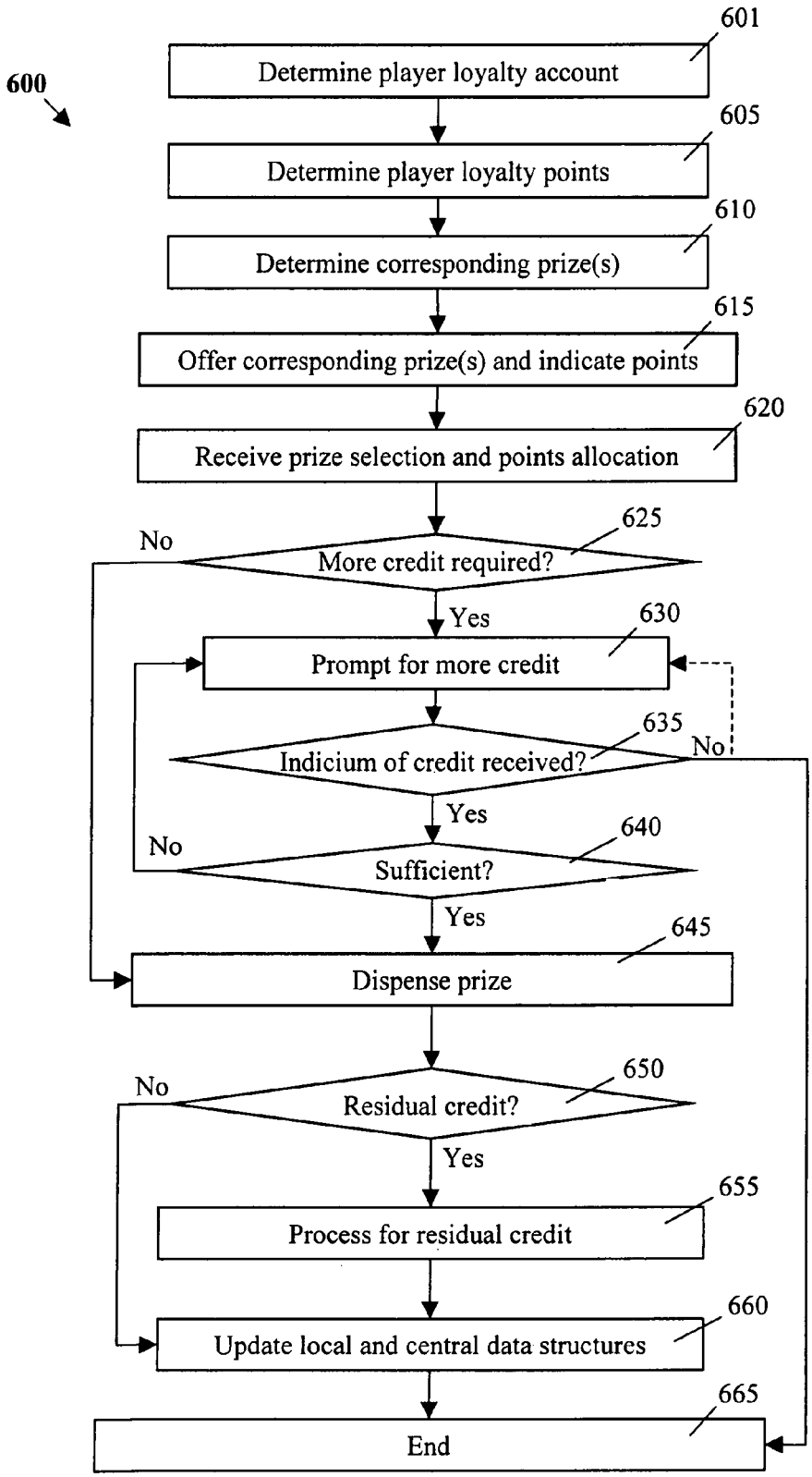
FIG. 6 is a flow chart that outlines methods of the invention.

Although not indicated in FIG. 6, method 600 may involve determining whether a selection is received within a predetermined time, e.g., from when a prize is offered, from when a player loyalty instrument is read, or from some other such time. If the selection is not received within such time, the player may be prompted again. At some point, the transaction may be cancelled.

However, in this example, a prize selection is received. (Step 620.) The selection may be indicated, e.g., via a graphical user interface, via a button corresponding with a prize (which may or may not be near a prize display), via a code entered, e.g., on a keypad, via a signal received from a wireless device, etc.

In some instances, a player may wish to combine player loyalty points and other indicia of credit, even if the player has enough player loyalty points for a selected prize. For example, a player loyalty account may indicate 15,698 points and a selected prize may be worth 10,000 points, but the player may wish to allocate less than 10,000 points for the prize. Therefore, in some implementations, step 620 may also involve receiving an indication of how many player loyalty points a player may wish to allocate for a selected prize.

In step 625, it is determined whether additional credit is required to obtain the selected prize. The determination may be made with reference to a data structure such as that indicated in FIG. 7. In this example, a player loyalty account indicates 4,328 points and prize H is selected. The player has indicated that 4,000 points should be allocated to prize H. Therefore, it is determined in step 625 that more credit is required.

The amount and type of additional credit required may vary according to the implementation. In this example, the user will need to provide some form of monetary credit to supplement the indicated player loyalty point allocation. The amount of additional monetary credit required may be determined according to a formula, by reference to a look-up table or other data structure, etc. In this example, it is determined with reference to FIG. 7 that an additional 1,000 player loyalty points would have been required for prize type H, then a conversion is made between player loyalty points and monetary credits. Here, a simple 100:1 ratio of points to dollars is used for the conversion, but any convenient algorithm or method may be applied. Accordingly, it is determined that an additional $10 of monetary credit will be required for prize H.

The user is then prompted to provide the additional indicia of credit. (Step 630.) The prompt may be made in a visible and/or audible form, e.g., via one or more display devices, speakers, etc. (See FIG. 8.) If no additional indicia of credit are received within a predetermined time (as determined in step 635), the player may be prompted again. The player may also be encouraged to make another prize selection, e.g., to select a prize for which the available and/or allocated number of points would be sufficient. Eventually, the transaction will be cancelled if no satisfactory response is received within a predetermined time, a predetermined number of prompts, or some other predetermined criterion or combination of criteria.

In this example, the player inserts a cash-out ticket having a monetary value of $14.32. This amount is sufficient (as determined in step 640), so prize H is provided to the player. (Step 645.) In step 650, it is determined that there is residual credit, so a logic system of the kiosk causes a residual credit process to be executed. (Step 655.) As described elsewhere herein, in some implementations of the invention, residual credit will not always be provided to a player.

However, in this implementation, some form of residual credit is provided to the player in step 655. For example, the player may be provided with the full value of the residual credit via a cashless instrument having a monetary value of $4.32, $4.32 in currency, a credit to a financial account associated with the player (such as an account maintained by a gaming establishment, a checking account or a credit card account), etc. Alternatively (or additionally), the player may be offered a lower-value prize in lieu of, or as part of, the residual credit. In this example, the player may be offered some combination of prizes A and B. (See FIG. 7.)

As in other methods described herein, a central data structure (and preferably a local data structure) should be updated to make a record of the transaction, keep track of the prize inventory in the kiosk, reconcile issued and redeemed cashless instruments, etc. (Step 660.)

Figure 8:
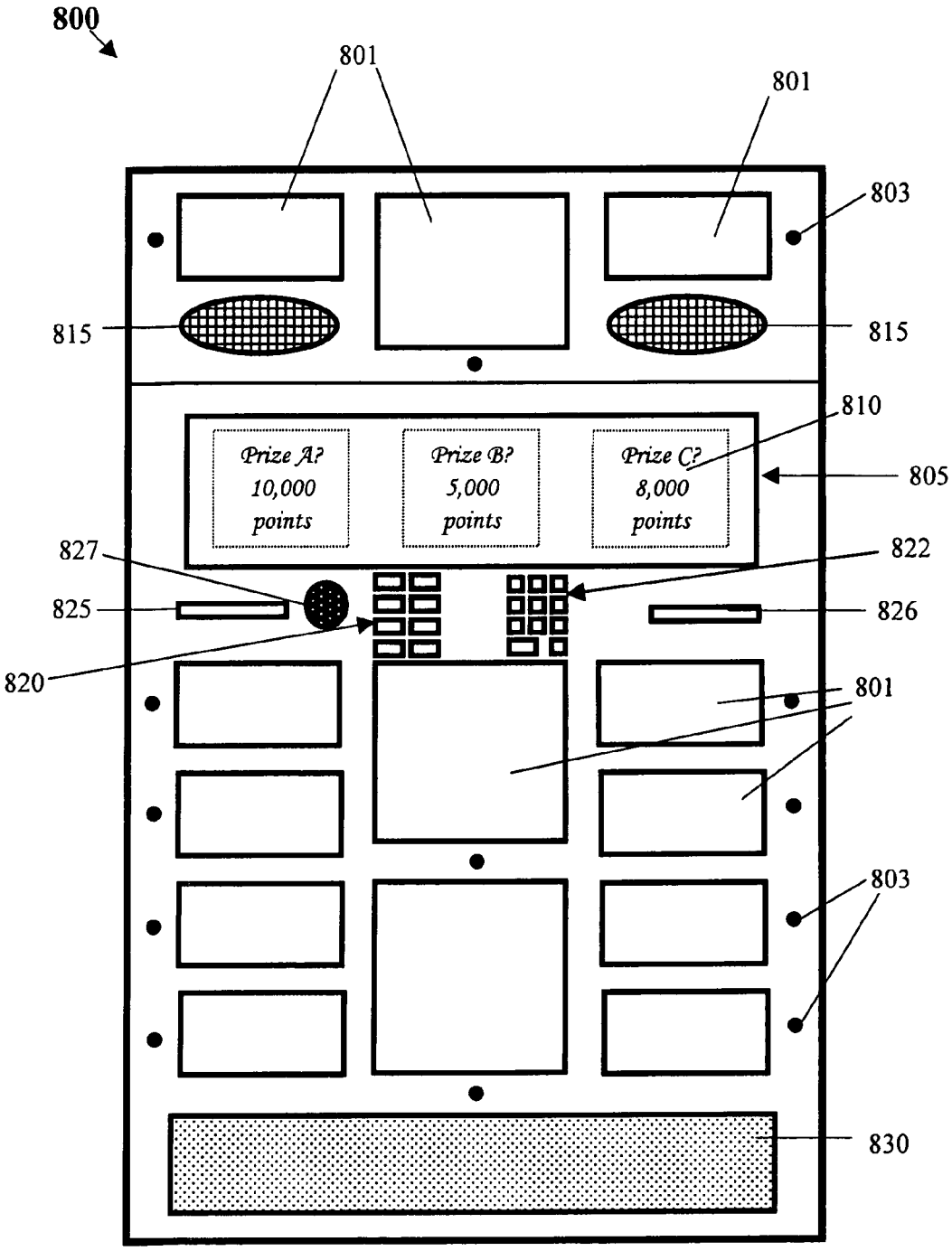
FIG. 8 depicts one example of a kiosk that may be provided by the present invention.

FIG. 8 depicts a simplified example of a kiosk that may be configured according to the present invention. As with other devices discussed and/or shown herein, the specific features indicated are merely examples. Some kiosks of the present invention may have more or fewer features than those shown in FIG. 8, may have more or fewer instances of the features shown, etc.

Kiosk 800 includes multiple prize displays 801 for depicting prizes and/or representations of prizes. Prize displays 801 may simply be windows through which prizes, pictures of prizes, etc., may be viewed. Alternatively, some or all of prize displays 801 may be liquid crystal displays ("LCDs") or the like for providing still or moving representations of prizes.

In this example, each of prize displays 801 has at least one associated selection indicator 803 with which a user may indicate a prize selection. In this example selection indicators 803 are buttons, but any convenient type of selection indicator known in the art may be used. In some implementations, one or more of controls 820 and/or controls 822 may also be used to select a prize.

In this example, controls 822 are configured as a key pad that may be used to input various types of information, such as player loyalty information, enter a pass code, respond to authentication challenges, etc. In some embodiments of the invention, controls 822 may be used to indicate how much of a particular credit type should be allocated to a prize, e.g., how many player loyalty points should be allocated to a prize.

Display 805 may be used to present various types of information to a user, to attract a user to the kiosk, etc. In this example, display 805 comprises a touch screen that can be used both to provide information and to receive user input, e.g., via one or more graphical user interfaces. However, display 805 may be any convenient display type known in the art, such as a plasma display or an LCD.

Here, display 105 is presenting screen 810, which indicates three prize options and three corresponding player loyalty point totals. This display may be made, for example, after determining a player's player loyalty point total and prior to receiving a prize selection from a user. The user may indicate a selection by touching the corresponding portion of screen 810, by activating one of buttons 803 and/or by interacting with one or more of controls 820 and/or controls 822. In this example, selected prizes are dispensed via opening 830, but prizes may be dispensed in any convenient manner.

Speakers 815 may also be used to attract a user to the kiosk and/or to present various types of information to the user. The speakers 815 may explain how a user can obtain prizes from the kiosk, provide entertaining or exciting messages about the available prizes, etc. Speakers 815 may also provide characteristic sounds that are associated with the kiosk itself and/or with prize themes. For example, a kiosk that can dispense prizes relating to a Star Wars® game and/or a special Star Wars® event may play music associated with Star Wars®, reproduce voices or other sounds from Star Wars® movies, etc.

Readers 825 and 826 may be used to read data from credit cards, debit cards, player loyalty instruments, cashless instruments, "smart cards" and the like. Accordingly, readers 825 and 826 may comprise bar code readers, magnetic strip readers, RFID readers, etc. Wireless interface 827 may be used for wireless communication with another device. In this example, wireless interface 827 is configured for communication with a hand-held device such as a personal digital assistant ("PDA") a cellular telephone, etc. Accordingly, wireless interface 827 may be configured for communication according to one of the IEEE 802.11 standards, via infrared signals, etc. One or more interfaces of kiosk 800 may be configured for communication with a financial institution and/or with the system of a financial intermediary such as PayPal® (which allows purchases via cellular telephone text messaging), NTT DoCoMo (which allows purchases via RFID communication with a processor in a cellular telephone), etc.

Figure 9:
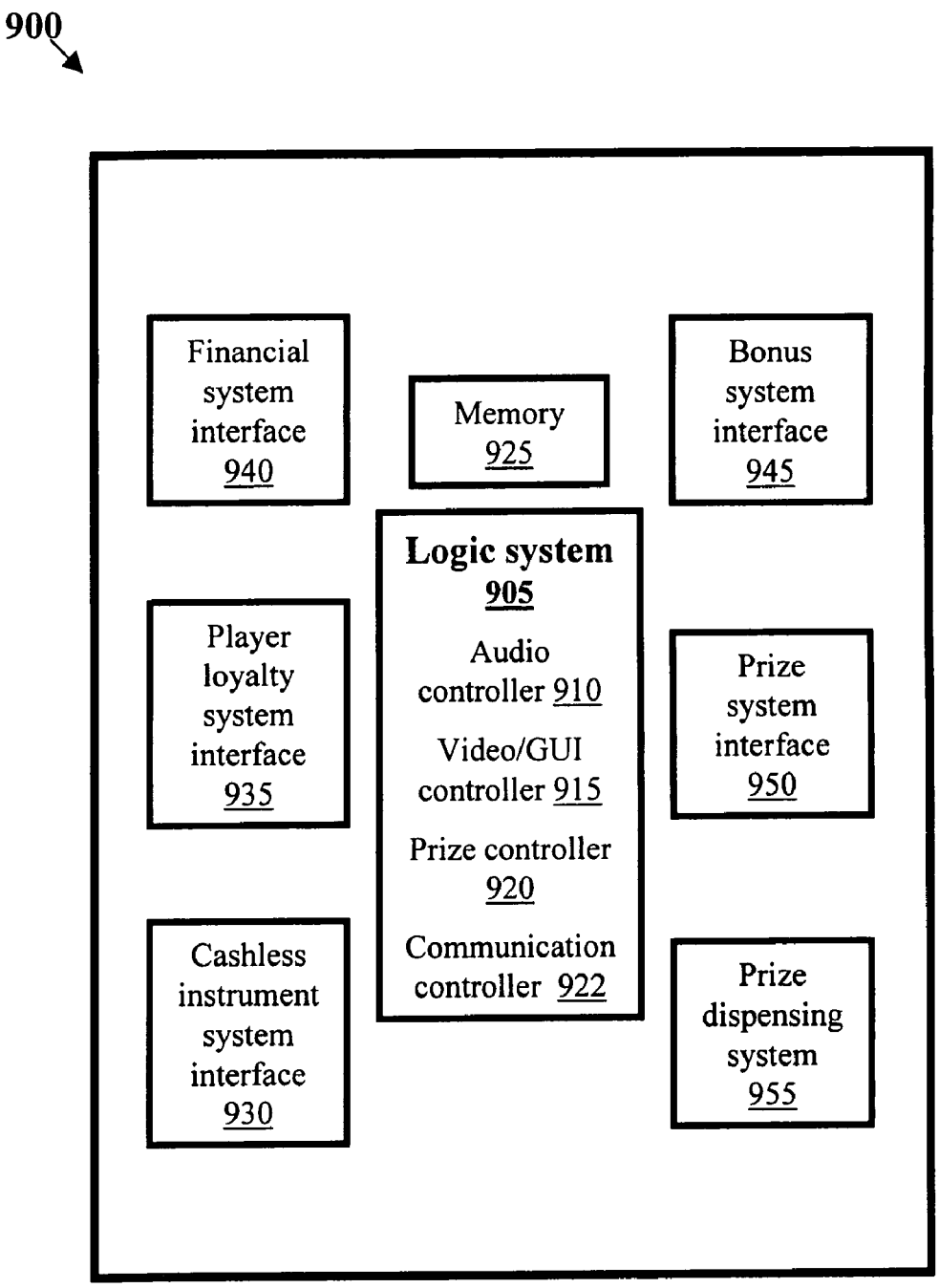
FIG. 9 is a block diagram that depicts examples of kiosk components that may be configured to provide some aspects of the present invention.

FIG. 9 is a block diagram that indicates examples of some such interfaces and other components. Kiosk 900 includes logic system 905, which is configured for controlling its various operations. Logic system 905 may comprise one or more logic devices, such as processors, programmable logic devices (e.g. field programmable gate arrays), etc., and is configured for communication with the other components indicated. In this example, there are dedicated controllers for the kiosk's audio system (audio controller 910), for the kiosk's video system (video/GUI controller 915), for prize determination and operation of prize dispensing system 955 (prize controller 920) and for communications with external devices (communication controller 922). However, these functions may be performed by a single device or by multiple devices, according to the implementation.

Here, logic system 905 includes one or more dedicated memories (e.g., a random access memory), but is also configured for communication with memory 925. In this example, memory 925 is a relatively large-capacity memory such as a hard drive.

Kiosk 900 includes a number of interfaces configured for communication with various external systems. In this context, an "external system" is intended to mean a system that is external to the kiosk. These external systems may include host devices, network devices (e.g., switches, routers and/or servers), etc., within a gaming establishment and/or outside of a gaming establishment.

For example, cashless instrument system interface 930, player loyalty system interface 935, bonus system interface 945 and prize system interface 950 are configured for communication with the corresponding systems of a gaming establishment. However, financial system interface 940 may be configured for communication with a gaming establishment's financial system and/or with external one or more external financial institutions (e.g., banks, credit card companies, the PayPal® system, NTT DoCoMo's system, etc.).

Some of the interfaces shown may be provided over the same physical device, e.g., via the same network interface. Conversely, some of the interfaces depicted as a single box may involve more than one physical interface. For example, the box labeled financial system interface 940 may represent both the interfaces through which the kiosk receives information from a user (e.g., reader 825, reader 826 and/or wireless interface 827) and the network interface(s) through which the kiosk communicates with one or more financial systems.

Prize dispensing system 955 includes the mechanisms for providing prizes to a user according to instructions from prize controller 920. Although the overall operation of kiosk 900 is novel, at least some of the mechanisms used by prize dispensing system 955 may operate in a manner similar to that of, e.g., vending machines known in the art.

Figure 10:
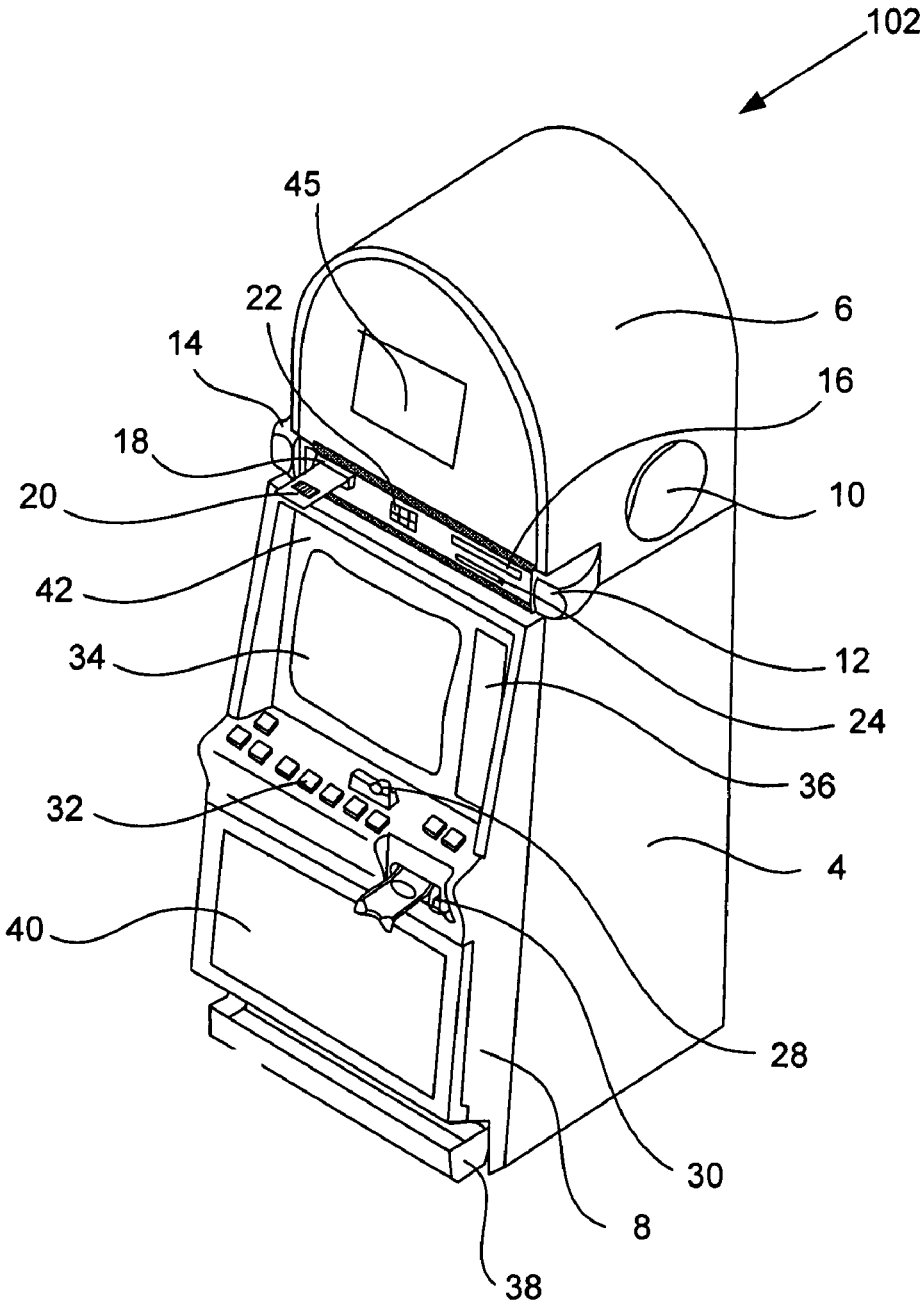
FIG. 10 illustrates a gaming machine that may be configured according to some aspects of the invention.

Turning next to FIG. 10, a video gaming machine 102 of the present invention is shown. Machine 102 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 will typically be a cathode ray tube, high resolution flat-panel LCD, or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 102 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 102 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 102 may be stored as game software on a mass storage device in the gaming machine or may be generated on a remote gaming device but then displayed on the gaming machine. The gaming machine 102 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 102 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2.

Understand that gaming machine 102 is but one example from a wide range of gaming machine designs on which the present invention may be implemented. For example, not all suitable gaming machines have top boxes or player tracking features. Further, some gaming machines have only a single game display—mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines of the present assignee are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in IGT gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as IGT gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, IGT's Netplex is a proprietary communication protocol used for serial communication between gaming devices. As another example, SAS is a communication protocol used to transmit information, such as metering information, from a gaming machine to a remote device. Often SAS is used in conjunction with a player tracking system.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 from U.S. patent application Ser. No. 09/925,098, filed Aug. 8, 2001 and titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 10, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 102 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 102 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 11:
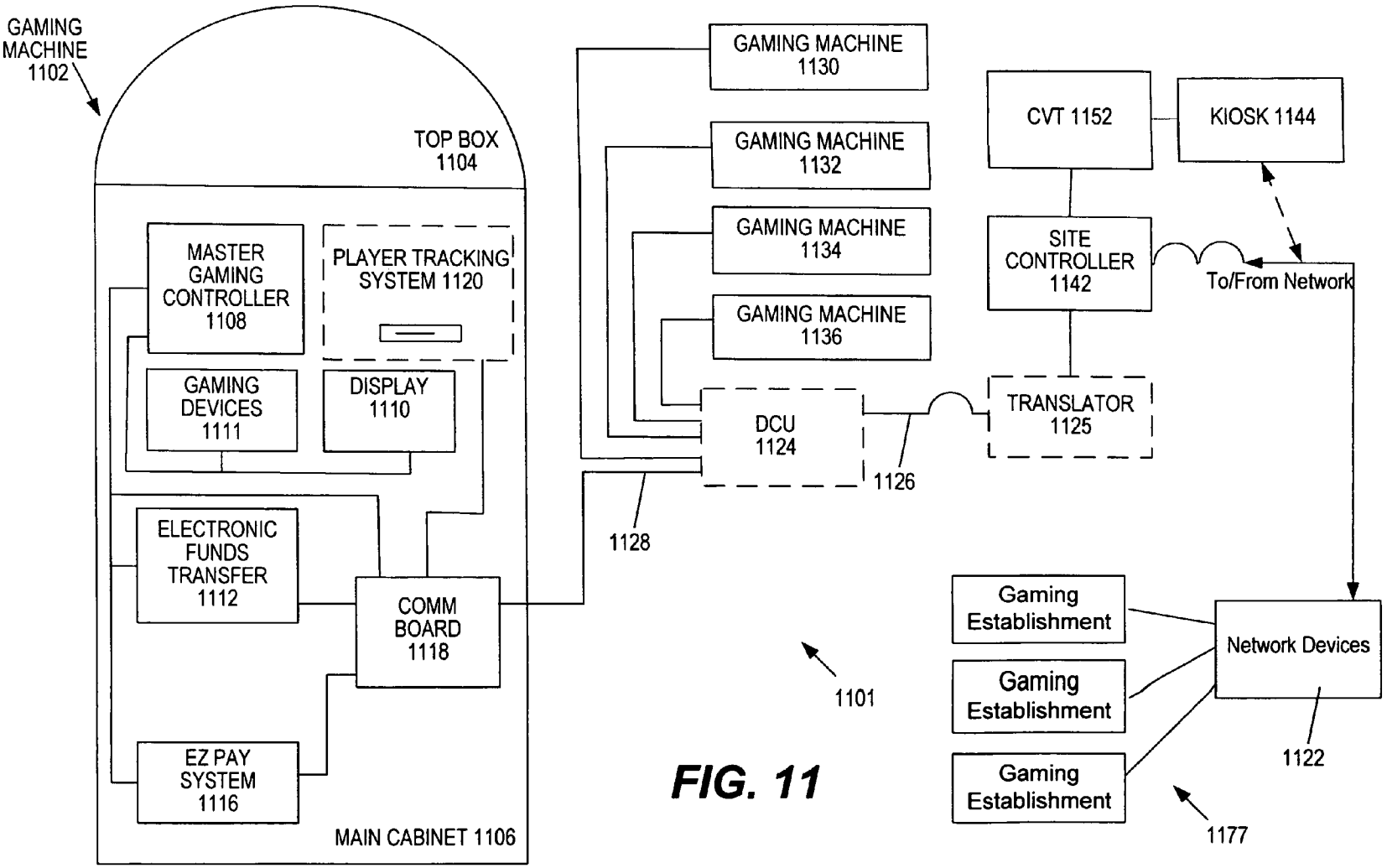
FIG. 11 illustrates a gaming machine and a gaming network that may be configured according to some aspects of the invention.

A gaming network that may be used to implement additional methods performed in accordance with embodiments of the invention is depicted in FIG. 11. Gaming establishment 1101 could be any sort of gaming establishment, such as a casino, a card room, an airport, a store, etc. In this example, gaming network 1177 includes more than one gaming establishment, all of which are networked to game server 1122.

Here, gaming machine 1102, and the other gaming machines 1130, 1132, 1134, and 1136, include a main cabinet 1106 and a top box 1104. The main cabinet 1106 houses the main gaming elements and can also house peripheral systems, such as those that utilize dedicated gaming networks. The top box 1104 may also be used to house these peripheral systems.

The master gaming controller 1108 controls the game play on the gaming machine 1102 according to instructions and/or game data from game server 1122 or stored within gaming machine 1102 and receives or sends data to various input/output devices 1111 on the gaming machine 1102. In one embodiment, master gaming controller 1108 includes processor(s) and other apparatus of the gaming machines described elsewhere herein. The master gaming controller 1108 may also communicate with a display 1110.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1108 may also communicate with EFT system 1112, EZPay™ system 1116 (a proprietary cashless ticketing system of the present assignee), and player tracking system 1120. The systems of the gaming machine 1102 communicate the data onto the network 1122 via a communication board 1118.

It will be appreciated by those of skill in the art that embodiments of the present invention could be implemented on a network with more or fewer elements than are depicted in FIG. 11. For example, player tracking system 1120 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Moreover, player tracking information may be combined with other information that is now readily obtainable by an SBG system.

Moreover, DCU 1124 and translator 1125 are not required for all gaming establishments 1101. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, in the gaming industry, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machine are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1142 provides this function for gaming establishment 1101. Site controller 1142 is connected to a central system and/or other gaming establishments via one or more networks, which may be public or private networks. Among other things, site controller 1142 communicates with game server 1122 to obtain game data, such as ball drop data, bingo card data, etc.

In the present illustration, gaming machines 1102, 1130, 1132, 1134 and 1136 are connected to a dedicated gaming network 1122. In general, the DCU 1124 functions as an intermediary between the different gaming machines on the network 1122 and the site controller 1142. In general, the DCU 1124 receives data transmitted from the gaming machines and sends the data to the site controller 1142 over a transmission path 1126. In some instances, when the hardware interface used by the gaming machine is not compatible with site controller 1142, a translator 1125 may be used to convert serial data from the DCU 1124 to a format accepted by site controller 1142. The translator may provide this conversion service to a plurality of DCUs.

Further, in some dedicated gaming networks, the DCU 1124 can receive data transmitted from site controller 1142 for communication to the gaming machines on the gaming network. The received data may be, for example, communicated synchronously to the gaming machines on the gaming network.

Here, CVT 1152 provides cashless and cashout gaming services to the gaming machines in gaming establishment 1101. Broadly speaking, CVT 1152 authorizes and validates cashless gaming machine instruments (also referred to herein as "tickets" or "vouchers"), including but not limited to tickets for causing a gaming machine to display a game result and cash-out tickets. Moreover, CVT 1152 authorizes the exchange of a cashout ticket for cash. These processes will be described in detail below. In one example, when a player attempts to redeem a cash-out ticket for cash at cashout kiosk 1144, cash out kiosk 1144 reads validation data from the cashout ticket and transmits the validation data to CVT 1152 for validation. The tickets may be printed by gaming machines, by cashout kiosk 1144, by a stand-alone printer, by CVT 1152, etc. Some gaming establishments will not have a cashout kiosk 1144. Instead, a cashout ticket could be redeemed for cash by a cashier (e.g. of a convenience store), by a gaming machine or by a specially configured CVT.

Information relevant to managing gaming networks, data communication within gaming networks, etc., is set forth in U.S. patent application Ser. No. 11/225,407, by Wolf et al., entitled "METHODS AND DEVICES FOR MANAGING GAMING NETWORKS" and filed Sep. 12, 2005, in U.S. patent application Ser. No. 10/757,609 by Nelson et al., entitled "METHODS AND APPARATUS FOR GAMING DATA DOWNLOADING" and filed on Jan. 14, 2004, in U.S. patent application Ser. No. 10/938,293 by Benbrahim et al., entitled "METHODS AND APPARATUS FOR DATA COMMUNICATION IN A GAMING SYSTEM" and filed on Sep. 10, 2004, in U.S. patent application Ser. No. 11/225,337 by Nguyen et al., filed Sep. 12, 2005 and entitled "DISTRIBUTED GAME SERVICES" and in U.S. patent application Ser. No. 11/173,442 by Kinsley et al., filed Jul. 1, 2005 and entitled "METHODS AND DEVICES FOR DOWNLOADING GAMES OF CHANCE," all of which are hereby incorporated by reference in their entirety and for all purposes. Some examples of gaming networks and devices are set forth below.

Figure 12:
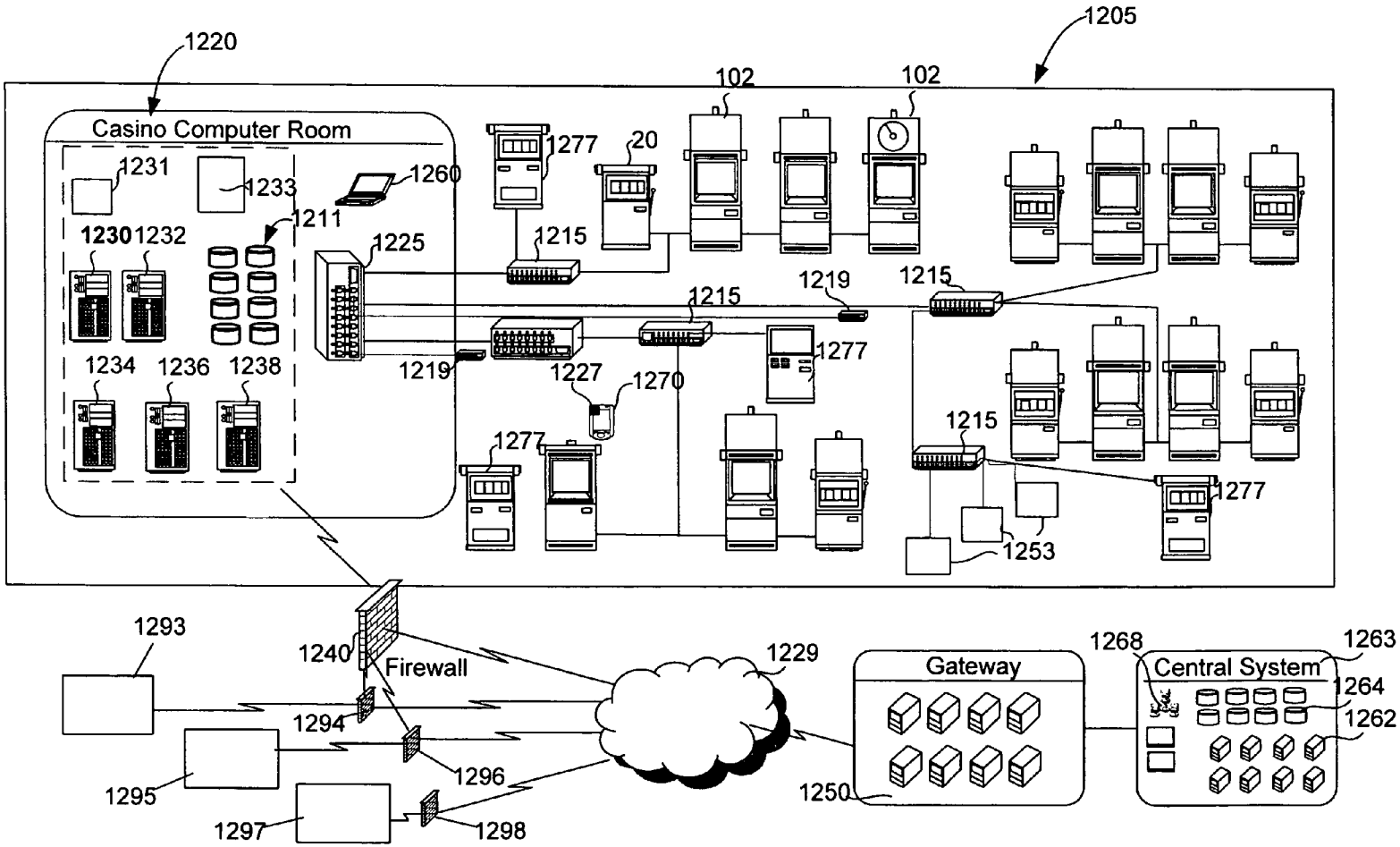
FIG. 12 depicts a simplified example of a server-based gaming network that may be used to implement, at least in part, some aspects of the invention.

Another example of a network topology for implementing some aspects of the present invention is shown in FIG. 12. Those of skill in the art will realize that this exemplary architecture and the related functionality are merely examples and that the present invention encompasses many other such embodiments and methods. Here, for example, a single gaming establishment 1205 is illustrated, which is a casino in this example. However, it should be understood that some implementations of the present invention involve multiple gaming establishments.

Gaming establishment 1205 includes 16 gaming machines 102, each of which is part of a bank 610 of gaming machines 102. In this example, gaming establishment 1205 also includes a bank of networked gaming tables 1253. It will be appreciated that many gaming establishments include hundreds or even thousands of gaming machines 102 and/or gaming tables 1253, not all of which are included in a bank. However, the present invention may be implemented in gaming establishments having any number of gaming machines, gaming tables, etc.

Various alternative network topologies can be used to implement different aspects of the invention and/or to accommodate varying numbers of networked devices. For example, gaming establishments with very large numbers of gaming machines 102 may require multiple instances of some network devices (e.g., of main network device 1225, which combines switching and routing functionality in this example) and/or the inclusion of other network devices not shown in FIG. 12. For example, some implementations of the invention include one or more middleware servers disposed between gaming machines 102 and server 1230. Such middleware servers can provide various useful functions, including but not limited to the filtering and/or aggregation of data received from bank switches 1215, from individual gaming machines and from other player terminals. Some implementations of the invention include load balancing methods and devices for managing network traffic.

Each bank 1210 has a corresponding bank switch 1215, which may be a conventional bank switch. Each bank switch is connected to server-based gaming ("SBG") server 1230 via main network device 1225, which combines switching and routing functionality in this example. Although various floor communication protocols may be used, some preferred implementations use IGT's open, Ethernet-based Super-SAS® protocol, which IGT makes available for downloading without charge. However, other protocols such as Best of Breed ("BOB") may be used to implement various aspects of SBG. IGT has also developed a gaming-industry-specific transport layer called CASH that rides on top of TCP/IP and offers additional functionality and security.

SBG server 1230, License Manager 1231, Arbiter 133, servers 1232, 1234, 1236 and 1238, and main network device 1225 are disposed within computer room 1220 of gaming establishment 1205. In practice, more or fewer servers may be used. Some of these servers may be configured to perform tasks relating to player loyalty and/or player tracking, bonusing/progressives, etc. One or more servers (as well as other devices) may be configured to perform tasks specific to the present invention, such as cashless instrument validation, prize preference determination, prize reconciliation/inventory, etc.

License Manager 1231 may also be implemented, at least in part, via a server or a similar device. Some exemplary operations of License Manager 1231 are described in detail in U.S. patent application Ser. No. 11/225,408, entitled "METHODS AND DEVICES FOR AUTHENTICATION AND LICENSING IN A GAMING NETWORK" by Kinsley et al., which is hereby incorporated by reference.

SBG server 1230 can also be configured to implement, at least in part, various aspects of the present invention. Some preferred embodiments of SBG server 1230 and the other servers shown in FIG. 12 include (or are at least in communication with) clustered CPUs, redundant storage devices, including backup storage devices, switches, etc. Such storage devices may include a redundant array of inexpensive disks ("RAID"), back-up hard drives and/or tape drives, etc. Preferably, a Radius and a DHCP server are also configured for communication with the gaming network. Some implementations of the invention provide one or more of these servers in the form of blade servers.

In some implementations of the invention, many of these devices (including but not limited to License Manager 1231, servers 1232, 1234, 1236 and 1238, and main network device 1225) are mounted in a single rack with SBG server 1230. Accordingly, many or all such devices will sometimes be referenced in the aggregate as an "SBG server." However, in alternative implementations, one or more of these devices is in communication with SBG server 1230 and/or other devices of the network but located elsewhere. For example, some of the devices could be mounted in separate racks within computer room 1220 or located elsewhere on the network. For example, it can be advantageous to store large volumes of data elsewhere via a storage area network ("SAN").

In some embodiments, these components are SBG server 1230 preferably has an uninterruptible power supply ("UPS"). The UPS may be, for example, a rack-mounted UPS module.

Computer room 1220 may include one or more operator consoles or other host devices that are configured for communication with SBG server 1230. Such host devices may be provided with software, hardware and/or firmware for implementing various aspects of the invention; many of these aspects involve controlling SBG server 1230. However, such host devices need not be located within computer room 1220. Wired host device 1260 (which is a laptop computer in this example) and wireless host device (which is a PDA in this example) may be located elsewhere in gaming establishment 1205 or at a remote location.

Arbiter 133 may be implemented, for example, via software that is running on a server or another networked device. Arbiter 133 serves as an intermediary between different devices on the network. Some implementations of Arbiter 133 are described in U.S. patent application Ser. No. 10/948,387, entitled "METHODS AND APPARATUS FOR NEGOTIATING COMMUNICATIONS WITHIN A GAMING NETWORK" and filed Sep. 23, 2004 (the "Arbiter Application"), which is incorporated herein by reference and for all purposes. In some preferred implementations, Arbiter 133 is a repository for the configuration information required for communication between devices on the gaming network (and, in some implementations, devices outside the gaming network). Although Arbiter 133 can be implemented in various ways, one exemplary implementation is discussed in the following paragraphs.

Figure 13:
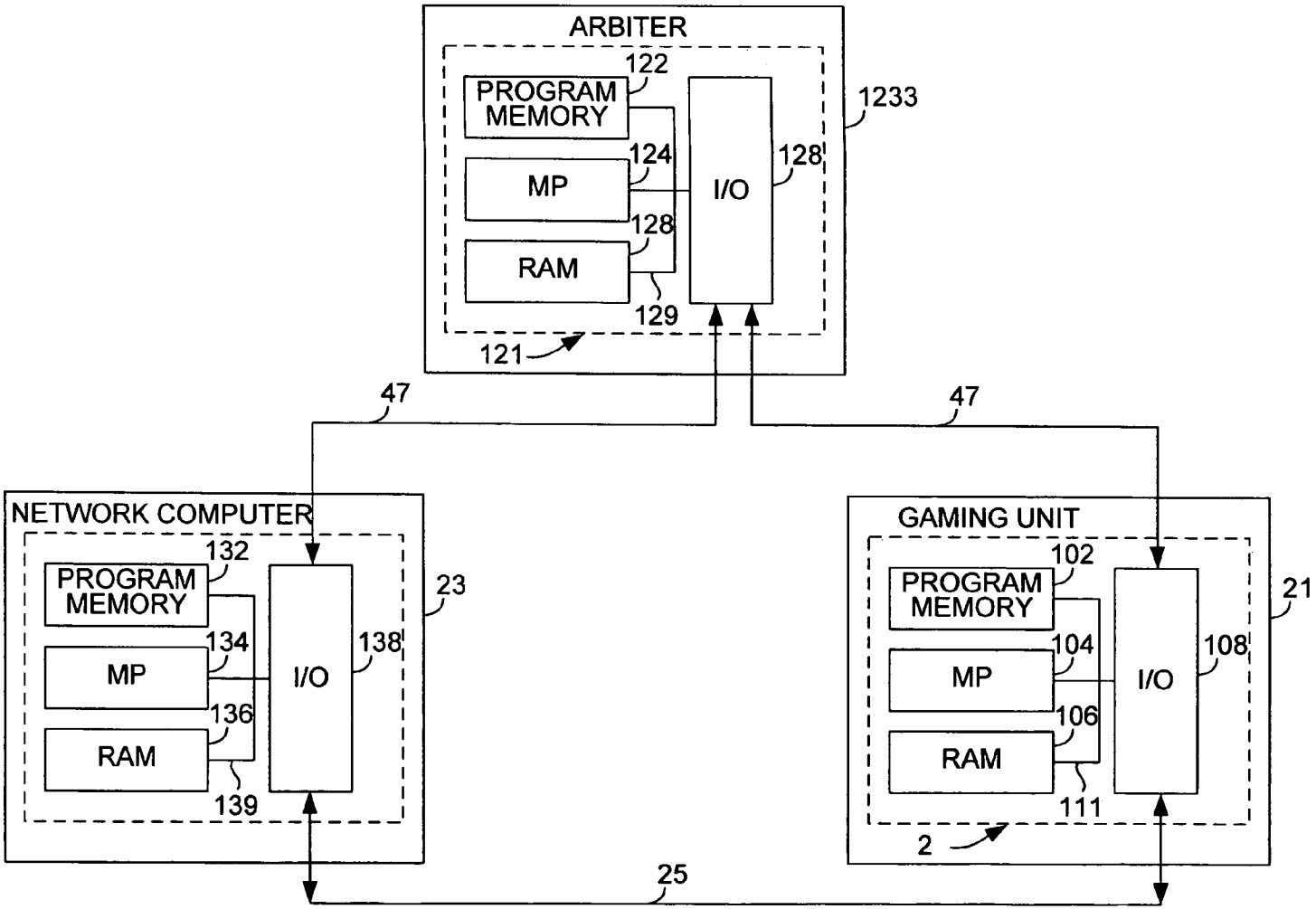
FIG. 13 is a block diagram of an Arbiter that may be used to implement, at least in part, some aspects of the invention.

FIG. 13 is a block diagram of a simplified communication topology between a gaming unit 21, the network computer 23 and the Arbiter 133. Although only one gaming unit 21, one network computer 23 and one Arbiter 133 are shown in FIG. 13, it should be understood that the following examples may be applicable to different types of network gaming devices within the gaming network 12 beyond the gaming unit 21 and the network computer 23, and may include different numbers of network computers, gaming security arbiters and gaming units. For example, a single Arbiter 133 may be used for secure communications among a plurality of network computers 23 and tens, hundreds or thousands of gaming units 21. Likewise, multiple gaming security arbiters 46 may be utilized for improved performance and other scalability factors.

Referring to FIG. 13, the Arbiter 133 may include an arbiter controller 121 that may comprise a program memory 122, a microcontroller or microprocessor (MP) 124, a random-access memory (RAM) 126 and an input/output (I/O) circuit 128, all of which may be interconnected via an address/data bus 129. The network computer 23 may also include a controller 131 that may comprise a program memory 132, a microcontroller or microprocessor (MP) 134, a random-access memory (RAM) 136 and an input/output (I/O) circuit 138, all of which may be interconnected via an address/data bus 139. It should be appreciated that although the Arbiter 133 and the network computer 23 are each shown with only one microprocessor 124, 134, the controllers 121, 131 may each include multiple microprocessors 124, 134. Similarly, the memory of the controllers 121, 131 may include multiple RAMs 126, 136 and multiple program memories 122, 132. Although the I/O circuits 128, 138 are each shown as a single block, it should be appreciated that the I/O circuits 128, 138 may include a number of different types of I/O circuits. The RAMs 124, 134 and program memories 122, 132 may be implemented as semiconductor memories, magnetically readable memories, and/or optically readable memories, for example.

Although the program memories 122, 132 are shown in FIG. 13 as read-only memories (ROM) 122, 132, the program memories of the controllers 121, 131 may be a read/write or alterable memory, such as a hard disk. In the event a hard disk is used as a program memory, the address/data buses 129, 139 shown schematically in FIG. 13 may each comprise multiple address/data buses, which may be of different types, and there may be an I/O circuit disposed between the address/data buses.

As shown in FIG. 13, the gaming unit 21 may be operatively coupled to the network computer 23 via the data link 25. The gaming unit 21 may also be operatively coupled to the Arbiter 133 via the data link 47, and the network computer 23 may likewise be operatively coupled to the Arbiter 133 via the data link 47. Communications between the gaming unit 21 and the network computer 23 may involve different information types of varying levels of sensitivity resulting in varying levels of encryption techniques depending on the sensitivity of the information. For example, communications such as drink orders and statistical information may be considered less sensitive. A drink order or statistical information may remain encrypted, although with moderately secure encryption techniques, such as RC4, resulting in less processing power and less time for encryption. On the other hand, financial information (e.g., account information, winnings, etc.), game download information (e.g., game software and game licensing information) and personal information (e.g., social security number, personal preferences, etc.) may be encrypted with stronger encryption techniques such as DES or 3DES to provide increased security.

As disclosed in further detail in the Arbiter Application, the Arbiter 133 may verify the authenticity of each network gaming device. The Arbiter 133 may receive a request for a communication session from a network device. For ease of explanation, the requesting network device may be referred to as the client, and the requested network device may be referred to as the host. The client may be any device on the network 12 and the request may be for a communication session with any other network device. The client may specify the host, or the gaming security arbiter may select the host based on the request and based on information about the client and potential hosts. The Arbiter 133 may provide encryption keys (session keys) for the communication session to the client via the secure communication channel. Either the host and/or the session key may be provided in response to the request, or may have been previously provided. The client may contact the host to initiate the communication session. The host may then contact the Arbiter 133 to determine the authenticity of the client. The Arbiter 133 may provide affirmation (or lack thereof) of the authenticity of the client to the host and provide a corresponding session key, in response to which the network devices may initiate the communication session directly with each other using the session keys to encrypt and decrypt messages.

Alternatively, upon receiving a request for a communication session, the Arbiter 133 may contact the host regarding the request and provide corresponding session keys to both the client and the host. The Arbiter 133 may then initiate either the client or the host to begin their communication session. In turn, the client and host may begin the communication session directly with each other using the session keys to encrypt and decrypt messages. An additional explanation of the communication request, communication response and key distribution is provided in the Arbiter Application.

Wireless devices are particularly useful for managing a gaming network. Such wireless devices could include, but are not limited to, laptops, PDAs or even cellular telephones. Referring once again to FIG. 12, one or more network devices in gaming establishment 1205 can be configured as wireless access points. For example, a casino manager may use a wireless handheld device to revise and/or schedule gaming machine configurations while roaming the casino floor. Similarly, a representative of a regulatory body could use a PDA to verify gaming machine configurations, generate reports, view activity logs, etc., while on the casino floor.

If a host device is located in a remote location, security methods and devices (such as firewalls, authentication and/or encryption) should be deployed in order to prevent the unauthorized access of the gaming network. Similarly, any other connection between gaming network 1205 and the outside world should only be made with trusted devices via a secure link, e.g., via a virtual private network ("VPN") tunnel. For example, the illustrated connection between SBG 1230, gateway 1250 and central system 1263 (here, IGT.com) that may be used for game downloads, etc., is advantageously made via a VPN tunnel.

An Internet-based VPN uses the open, distributed infrastructure of the Internet to transmit data between sites. A VPN may emulate a private IP network over public or shared infrastructures. A VPN that supports only IP traffic is called an IP-VPN. VPNs provide advantages to both the service provider and its customers. For its customers, a VPN can extend the IP capabilities of a corporate site to remote offices and/or users with intranet, extranet, and dial-up services. This connectivity may be achieved at a lower cost to the gaming entity with savings in capital equipment, operations, and services. Details of VPN methods that may be used with the present invention are described in the reference, "Virtual Private Networks-Technologies and Solutions," by R. Yueh and T. Strayer, Addison-Wesley, 2001, ISBN#0-201-70209-6, which is incorporated herein by reference and for all purposes.

There are many ways in which IP VPN services may be implemented, such as, for example, Virtual Leased Lines, Virtual Private Routed Networks, Virtual Private Dial Networks, Virtual Private LAN Segments, etc. Additionally VPNs may be implemented using a variety of protocols, such as, for example, IP Security (IPSec) Protocol, Layer 2 Tunneling Protocol, Multiprotocol Label Switching (MPLS) Protocol, etc. Details of these protocols, including RFC reports, may be obtained from the VPN Consortium, an industry trade group (http://www.vpnc.com, VPNC, Santa Cruz, Calif.).

For security purposes, any information transmitted to or from a gaming establishment over a public network may be encrypted. In one implementation, the information may be symmetrically encrypted using a symmetric encryption key, where the symmetric encryption key is asymmetrically encrypted using a private key. The public key may be obtained from a remote public key server. The encryption algorithm may reside in processor logic stored on the gaming machine. When a remote server receives a message containing the encrypted data, the symmetric encryption key is decrypted with a private key residing on the remote server and the symmetrically encrypted information sent from the gaming machine is decrypted using the symmetric encryption key. A different symmetric encryption key is used for each transaction where the key is randomly generated. Symmetric encryption and decryption is preferably applied to most information because symmetric encryption algorithms tend to be 100-10,000 faster than asymmetric encryption algorithms.

As mentioned elsewhere herein, U.S. patent application Ser. No. 11/225,408, entitled "METHODS AND DEVICES FOR AUTHENTICATION AND LICENSING IN A GAMING NETWORK" by Kinsley et al., describes novel methods and devices for authentication, game downloading and game license management. This application has been incorporated herein by reference.

Providing a secure connection between the local devices of the SBG system and IGT's central system allows for the deployment of many advantageous features. For example, a customer (e.g., an employee of a gaming establishment) can log onto an account of central system 1263 (in this example, IGT.com) to obtain the account information such as the customer's current and prior account status.

Moreover, such a secure connection may be used by the central system 1263 to collect information regarding a customer's system. Such information includes, but is not limited to, error logs for use in diagnostics and troubleshooting. Some implementations of the invention allow a central system to collect other types of information, e.g., information about the usage of certain types of gaming software, revenue information regarding certain types of games and/or gaming machines, etc. Such information includes, but is not limited to, information regarding the revenue attributable to particular games at specific times of day, days of the week, etc. Such information may be obtained, at least in part, by reference to an accounting system of the gaming network(s), as described in U.S. patent application Ser. No. 11/225,407, by Wolf et al., entitled "METHODS AND DEVICES FOR MANAGING GAMING NETWORKS," which has been incorporated herein by reference.

Automatic updates of a customer's SBG server may also be enabled. For example, central system 1263 may notify a local SBG server regarding new products and/or product updates. For example, central system 1263 may notify a local SBG server regarding updates of new gaming software, gaming software updates, peripheral updates, the status of current gaming software licenses, etc. In some implementations of the invention, central system 1263 may notify a local SBG server (or another device associated with a gaming establishment) that an additional theme-specific data set and/or updates for a previously-downloaded global payout set are available. Alternatively, such updates could be automatically provided to the local SBG server and downloaded to networked gaming machines.

After the local SBG server receives this information, it can identify relevant products of interest. For example, the local SBG server may identify gaming software that is currently in use (or at least licensed) by the relevant gaming entity and send a notification to one or more host devices, e.g., via email. If an update or a new software product is desired, it can be downloaded from the central system. Some relevant downloading methods are described elsewhere herein and in applications that have been incorporated herein by reference, e.g., in U.S. patent application Ser. No. 11/078,966. Similarly, a customer may choose to renew a gaming software license via a secure connection with central system 1263 in response to such a notification.

Secure communication links allow notifications to be sent securely from a local SBG server to host devices outside of a gaming establishment. For example, a local SBG server can be configured to transmit automatically generated email reports, text messages, etc., based on predetermined events that will sometimes be referred to herein as "triggers." Such triggers can include, but are not limited to, the condition of a gaming machine door being open, cash box full, machine not responding, verification failure, etc.

In addition, providing secure connections between different gaming establishments can enable alternative implementations of the invention. For example, a number of gaming establishments, each with a relatively small number of gaming machines, may be owned and/or controlled by the same entity. In such situations, having secure communications between gaming establishments makes it possible for a gaming entity to use a single SBG server as an interface between central system 1263 and the gaming establishments.

Although many of the components and processes are described above in the singular for convenience, it will be appreciated by one of skill in the art that multiple components and repeated processes can also be used to practice the techniques of the present invention. Similarly, although illustrative embodiments and applications of this invention are shown and described herein, many variations and modifications are possible which remain within the concept, scope, and spirit of the invention, and these variations would become clear to those of ordinary skill in the art after perusal of this application.

For example, other implementations of the invention provide a "scavenger hunt" or the like. In some such implementations, a player needs to earn prizes relating to different games and/or different casinos within a defined time period. Each player may be required to register and may receive a list that is specific to him or her.

Accordingly, the present embodiments are to be considered as illustrative and not restrictive, and the invention is not to be limited to the details given herein, but may be modified within the scope and equivalents of the appended claims.

We claim:

1. A kiosk, comprising:

a cashless instrument reader configured to determine cashless instrument information from a cashless instrument issued by a wager gaming machine;

an indicator for indicating a plurality of non-cash physical merchandise prizes to a player;

a mechanism configured to provide a non-cash physical merchandise prize in the plurality of non-cash physical merchandise prizes; and a logic system configured to:

determine that the cashless instrument is redeemable at the kiosk for one or more of the non-cash physical merchandise prizes in the plurality of non-cash physical merchandise prizes based on the cashless instrument information;

determine a cashless instrument monetary value from the cashless instrument information;

determine a non-cash physical merchandise prize monetary value that is greater than the cashless instrument monetary value;

calculate a monetary difference between the non-cash physical merchandise prize monetary value and the cashless instrument monetary value; and control the indicator to indicate the one or more non-cash physical merchandise prizes.

2. The kiosk of claim 1, wherein the logic system comprises at least one processor.

3. The kiosk of claim 1, wherein cashless instrument reader comprises a ticket reader.

4. The kiosk of claim 1, wherein the cashless instrument information comprises a monetary value of the cashless instrument.

5. The kiosk of claim 1, wherein the cashless instrument information comprises a code that corresponds with the one or more non-cash physical merchandise prizes.

6. The kiosk of claim 1, further comprising a memory having a data structure stored therein, the data structure including information identifying each non-cash physical merchandise prize in the plurality of non-cash physical merchandise prizes and corresponding redemption requirements information, wherein the redemption requirements information for each non-cash physical merchandise prize indicates requirements that the cashless instrument information of the cashless instrument must meet to establish that the cashless instrument is redeemable for the corresponding non-cash physical merchandise prize.

7. The kiosk of claim 6, wherein the redemption requirements information comprises a monetary amount.

8. The kiosk of claim 1, wherein the mechanism comprises a system for dispensing the non-cash physical merchandise prizes.

9. The kiosk of claim 1, further comprising a display of the plurality of the non-cash physical merchandise prizes.

10. The kiosk of claim 1, further comprising an input device configured to receive an input indicating a selection of a non-cash physical merchandise prize.

11. The kiosk of claim 1, further comprising a cashless instrument validator.

12. The kiosk of claim 1, further comprising a cashless instrument voider.

13. The kiosk of claim 1, wherein the indicator comprises at least one of a display device and an audio device.

14. The kiosk of claim 1, further comprising a player loyalty account interface configured to receive player loyalty account information, wherein the logic system is further configured to determine that the cashless instrument is redeemable at the kiosk for one or more of the non-cash physical merchandise prizes in the plurality of non-cash physical merchandise prizes based on the combination of the cashless instrument information with the player loyalty account information.

15. The kiosk of claim 6, wherein the redemption requirements information comprises a range of monetary amounts.

16. The kiosk of claim 7, wherein the logic system is further configured to: determine a cashless instrument monetary value from the cashless instrument information;

select a non-cash physical merchandise prize with corresponding redemption requirements information indicating a monetary value that is less than or equal to the cashless instrument monetary value;

calculate a monetary difference between the cashless instrument monetary value and the monetary value indicated by the corresponding redemption requirements information; and provide at least one indicium of value corresponding to the monetary difference.

17. The kiosk of claim 1, further comprising a messaging device configured to provide a message, wherein the logic system is further configured to do the following:

select a non-cash physical merchandise prize with corresponding redemption requirements indicating a monetary amount corresponding with the non-cash physical merchandise prize monetary value;

and cause the messaging device to provide a message indicating that the non-cash physical merchandise prize with corresponding redemption requirements indicating a monetary amount corresponding with the non-cash physical merchandise prize monetary value may be obtained for the monetary difference.

18. The kiosk of claim 10, wherein the input device comprises at least one of a button panel, a graphical user interface provided on a display device, a microphone and a dial.

19. The kiosk of claim 1, wherein the logic system is further configured to do the following:

determine a monetary value of the cashless instrument from the cashless instrument information; and determine a range of monetary values including the monetary value of the cashless instrument, wherein the determining that the cashless instrument is redeemable at the kiosk for the one or more of the non-cash physical merchandise prizes in the plurality of non-cash physical merchandise prizes is based on monetary values of the one or more non-cash physical merchandise prizes being within the range of monetary values.

20. The kiosk of claim 19, wherein the logic system is further configured to control at least one of a speaker or a display device to offer at least one of the one or more non-cash physical merchandise prizes.

21. A kiosk, comprising:

player loyalty account interface configured to receive player loyalty account information from a player loyalty instrument issued by a wager gaming machine;

an indicator for indicating a plurality of non-cash physical merchandise prizes to a player;

a mechanism configured to provide a physical merchandise prize in the plurality of non-cash physical merchandise prizes; and a logic system configured to:

determine a player loyalty point amount that corresponds with the player loyalty account information;

determine a non-cash physical merchandise prize player loyalty point value that is greater than the player loyalty point amount;

calculate a monetary amount corresponding to the difference between the non-cash physical merchandise player loyalty point value and the player loyalty point amount;

determine that one or more player loyalty points in the player loyalty point amount is redeemable at the kiosk for one or more of the non-cash physical merchandise prizes in the plurality of non-cash physical merchandise prizes based on the player loyalty point amount; and control the indicator to indicate the one or more non-cash physical merchandise prizes.

22. The kiosk of claim 21, wherein the indicator comprises at least one of a display device and an audio device.

23. The kiosk of claim 21, further comprising a cashless instrument reader configured to determine cashless instrument information from a cashless instrument issued by a wager gaming machine, wherein the logic system is further configured to determine that the one or more player loyalty points in combination with the cashless instrument information is redeemable at the kiosk for at least one of the one or more of the non-cash physical merchandise prizes in the plurality of non-cash physical merchandise prizes.

24. The kiosk of claim 21, wherein the indicator comprises a plurality of windows for displaying non-cash physical merchandise prizes or representations of non-cash physical merchandise prizes.

25. The kiosk of claim 21, wherein the logic system comprises at least one processor.

26. The kiosk of claim 21, wherein the player loyalty account interface comprises a player loyalty card reader.

27. The kiosk of claim 21, further comprising a memory having a data structure stored therein, the data structure including information identifying each non-cash physical merchandise prize in the plurality of non-cash physical merchandise prizes and corresponding redemption requirements information, wherein the redemption requirements information for each non-cash physical merchandise prize indicates requirements~that the one or more player loyalty points must meet to establish that the one or more player loyalty points are redeemable for the corresponding non-cash physical merchandise prize.

28. The kiosk of claim 21, further comprising a memory having a data structure stored therein, the data structure indicating non-cash physical merchandise prizes and corresponding non-cash physical merchandise prize monetary values.

29. The kiosk of claim 21, further comprising an input device configured to receive an input indicating a selection of a non-cash physical merchandise prize.

30. The kiosk of claim 23, wherein the cashless instrument information comprises a monetary value of the cashless instrument.

31. The kiosk of claim 23, wherein the cashless instrument information comprises a code that corresponds with a non-cash physical merchandise prize.

32. The kiosk of claim 23, further comprising a memory having a data structure stored therein, the data structure indicating non-cash physical merchandise prizes and corresponding non-cash physical merchandise prize monetary values.

33. The kiosk of claim 23, further comprising a memory having a data structure stored therein, the data structure indicating non-cash physical merchandise prizes and corresponding cashless instrument information.

34. The kiosk of claim 29, wherein the receiving input device comprises at least one of a button panel, a graphical user interface provided on a display device, a microphone and a dial.

35. The kiosk of claim 32, wherein the logic system is further configured to do the following:

determine a combination value based on the combination of the player loyalty account information and the cashless instrument information, determine whether there is a non-cash physical merchandise prize with a non-cash physical merchandise prize value that is less than or equal to the combination value;

determine, when there is a non-cash physical merchandise prize value that is less than or equal to the cashless instrument value, a second non-cash physical merchandise prize corresponding with the non-cash physical merchandise prize value;

calculate a value difference between the cashless instrument value and the non-cash physical merchandise prize value; and provide at least one indicium of value corresponding to the value difference.

36. The kiosk of claim 32, wherein the logic system is further configured to do the following:

determine a combination value based on the combination of the player loyalty account information and the cashless instrument information;

determine whether there is a non-cash physical merchandise prize with a non-cash physical merchandise prize value that is greater than the combination value;

determine a second non-cash physical merchandise prize corresponding with the non-cash physical merchandise prize value;

calculate a value difference between the non-cash physical merchandise prize value and the combination value; and cause the indicator to provide a message indicating that the second non-cash physical merchandise prize could be obtained for the value difference.

37. The kiosk of claim 35, wherein the non-cash physical merchandise prize value is at least one of a monetary value and a player loyalty point value.

38. The kiosk of claim 36, wherein the non-cash physical merchandise prize value is at least one of a monetary value and a player loyalty point value.

39. The kiosk of claim 21, wherein the logic system is further configured to cause the indicator to provide a message indicating that a non-cash physical merchandise prize with a player loyalty point value that is greater than the player loyalty point amount may be obtained in exchange for the player loyalty point amount and the monetary amount corresponding to the difference between the non-cash physical merchandise prize player loyalty point value and the player loyalty point amount.

* * * * *

UNITED STATES PATENT AND TRADEMARK OFFICE

CERTIFICATE OF CORRECTION

PATENT NO. : 8,308,554 B2
APPLICATION NO. : 11/821145
DATED : November 13, 2012
INVENTOR(S) : Richard E. Rowe et al.

It is certified that error appears in the above-identified patent and that said Letters Patent is hereby corrected as shown below:

In line 17 of claim 21 (column 34, line 22), change "physical merchandise player" to --physical merchandise prize player--.

In line 8 of claim 27 (column 34, line 57), change "requirements~that" to --requirements that--.

Signed and Sealed this
Twenty-sixth Day of February, 2013

Teresa Stanek Rea
*Acting Director of the United States Patent and Trademark Office*